US008117683B2

(12) United States Patent
Yamamoto et al.

(10) Patent No.: US 8,117,683 B2
(45) Date of Patent: Feb. 21, 2012

(54) TOILET SEAT DEVICE AND TOILET SEAT APPARATUS HAVING THE SAME

(75) Inventors: Yuuji Yamamoto, Nara (JP); Hidetoshi Amaya, Shiga (JP); Shinji Fujii, Shiga (JP); Noboru Okui, Nara (JP); Hiroshi Nagasato, Nara (JP); Kenji Yoshinaga, Nara (JP); Masahiro Takiguchi, Nara (JP); Kazuya Kondoh, Osaka (JP); Eiichi Tanaka, Kyoto (JP); Mitsuhiro Fukuda, Nara (JP)

(73) Assignee: Panasonic Corporation (JP)

( * ) Notice: Subject to any disclaimer, the term of this patent is extended or adjusted under 35 U.S.C. 154(b) by 1088 days.

(21) Appl. No.: 11/994,039

(22) PCT Filed: Jun. 26, 2006

(86) PCT No.: PCT/JP2006/312756

§ 371 (c)(1),
(2), (4) Date: Dec. 27, 2007

(87) PCT Pub. No.: WO2007/000981

PCT Pub. Date: Jan. 4, 2007

(65) Prior Publication Data

US 2009/0025131 A1 Jan. 29, 2009

(30) Foreign Application Priority Data

Jun. 29, 2005 (JP) ..... 2005-189419
Jun. 29, 2005 (JP) ..... 2005-189420
Jun. 29, 2005 (JP) ..... 2005-189421
Aug. 22, 2005 (JP) ..... 2005-240311

(51) Int. Cl.
*A47K 13/00* (2006.01)

(52) U.S. Cl. ..... 4/237; 4/DIG. 6

(58) Field of Classification Search ..... 4/237, DIG. 6
See application file for complete search history.

(56) References Cited

U.S. PATENT DOCUMENTS 4,850,060 A * 7/1989 Chieng Ming ..... 4/237

(Continued)

FOREIGN PATENT DOCUMENTS

JP 60-105726 6/1985

(Continued)

OTHER PUBLICATIONS

English machine translation of JP 2002-186570 to Toto Ltd.*

(Continued)

*Primary Examiner* — Korie Chan
(74) *Attorney, Agent, or Firm* — Brinks Hofer Gilson & Lione

(57) ABSTRACT

Provided are a toilet seat device saving energy and accurately stabilizing the temperature of a seating section at a predetermined level in a short time, and a toilet apparatus having the same. A control section adjusts the temperature of a toilet seat section to 18° C. when a heating function is turned on, and during a standby period D1, the control section performs low electric power drive of a lamp heater provided at the toilet seat section. The control section starts 600 W drive of the lamp heater at time t1 after the control section detects user's entry into a room, and the control section maintains the 600 W drive during an inrush current reduction period D2. The control section starts 1200 W drive of the lamp heater at time t2 and maintains the 1200 W drive during a first temperature rise period D3. After the temperature of the seating section reaches limit temperature, the control section starts 600 W drive of the lamp heater at time t3 and maintains the 600 W drive during a second temperature rise period D4. After the temperature of the seating section reaches a temperature higher than a toilet seat set temperature, the control section starts low electric power drive of the lamp heater at time t4.

13 Claims, 28 Drawing Sheets

U.S. PATENT DOCUMENTS

| | | | | |
|---|---|---|---|---|
| 5,084,917 | A * | 2/1992 | Matsubara et al. | 4/237 |
| 5,095,555 | A * | 3/1992 | Torii et al. | 4/237 |
| 5,642,531 | A * | 7/1997 | Holtom et al. | 4/237 |
| 5,940,895 | A * | 8/1999 | Wilson et al. | 4/237 |
| 6,294,758 | B1 * | 9/2001 | Masao et al. | 219/217 |

FOREIGN PATENT DOCUMENTS

| | | |
|---|---|---|
| JP | 61217124 A | 9/1986 |
| JP | 62-037713 | 2/1987 |
| JP | 62056714 A | 3/1987 |
| JP | 01-113011 | 5/1989 |
| JP | 02-036828 | 2/1990 |
| JP | 351269 B2 | 8/1991 |
| JP | 2000-014598 | 1/2000 |
| JP | 2000-210230 | 8/2000 |
| JP | 2001135458 A | 5/2001 |
| JP | 2002-186570 | 7/2002 |

OTHER PUBLICATIONS

International Search Report Dated Jul. 18, 2006.

* cited by examiner

FIG. 8

| MEASUREMENT TEMPERATURE AT THE TIME OF USER'S ENTRY [°C] | TOILET SEAT SET TEMPERATURE "LOW": 34 °C SETTING | | | | |
|---|---|---|---|---|---|
| | 600W DRIVE FOR REDUCING INRUSH CURRENT [Sec] | 1200 W DRIVE [Sec] | 1200 W → 600 W CONVERSION TEMPERATURE [°C] | 600 W DRIVE [Sec] | TARGET TEMPERATURE [°C] |
| 0～2 | | | | 16.0 | 16.5 |
| 2～4 | | | | 14.0 | 16.5 |
| 4～6 | | | | 12.0 | 16.5 |
| 6～8 | | | | 10.0 | 16.5 |
| 8～10 | | | | 8.0 | 16.5 |
| 10～12 | | | | 6.0 | 16.5 |
| 12～14 | | | | 4.0 | 16.5 |
| 14～16 | | | | 2.0 | 16.5 |
| 16～18 | 0.2 | 6.0 | 23.0 | 2.1 | 25.5 |
| 18～20 | 0.2 | 5.1 | 23.3 | 2.3 | 26.6 |
| 20～22 | 0.2 | 4.3 | 24.2 | 2.4 | 27.7 |
| 22～24 | 0.2 | 3.4 | 26.5 | 2.4 | 28.8 |
| 24～26 | 0.2 | 2.5 | 28.3 | 2.3 | 29.0 |
| 26～28 | 0.2 | 1.6 | 29.0 | 2.1 | 30.9 |
| 28～30 | | | | 3.3 | 30.6 |
| 30～32 | | | | 2.6 | 32.3 |
| 32～34 | | | | | |
| 34～36 | | | | | |
| 36～38 | | | | | |
| 38～ | | | | | |

FIG. 9

| MEASUREMENT TEMPERATURE AT THE TIME OF USER'S ENTRY [°C] | TOILET SEAT SET TEMPERATURE "NORMAL": 36 °C SETTING | | | | |
|---|---|---|---|---|---|
| | 600W DRIVE FOR REDUCING INRUSH CURRENT [Sec] | 1200 W DRIVE [Sec] | 1200 W → 600 W CONVERSION TEMPERATURE [°C] | 600 W DRIVE [Sec] | TARGET TEMPERATURE [°C] |
| 0～ 2 | | | | 16.0 | 16.5 |
| 2～ 4 | | | | 14.0 | 16.5 |
| 4～ 6 | | | | 12.0 | 16.5 |
| 6～ 8 | | | | 10.0 | 16.5 |
| 8～10 | | | | 8.0 | 16.5 |
| 10～12 | | | | 6.0 | 16.5 |
| 12～14 | | | | 4.0 | 16.5 |
| 14～16 | | | | 2.0 | 16.5 |
| 16～18 | 0.2 | 6.0 | 23.0 | 3.8 | 27.9 |
| 18～20 | 0.2 | 5.1 | 23.3 | 4.2 | 29.0 |
| 20～22 | 0.2 | 4.3 | 24.2 | 4.3 | 30.1 |
| 22～24 | 0.2 | 3.4 | 26.5 | 4.4 | 31.2 |
| 24～26 | 0.2 | 2.5 | 28.3 | 4.3 | 32.3 |
| 26～28 | 0.2 | 1.6 | 29.0 | 4.2 | 33.4 |
| 28～30 | | | | 5.2 | 31.8 |
| 30～32 | | | | 3.5 | 32.7 |
| 32～34 | | | | 2.6 | 34.3 |
| 34～36 | | | | | |
| 36～38 | | | | | |
| 38～ | | | | | |

| MEASUREMENT TEMPERATURE AT THE TIME OF USER'S ENTRY [°C] | TOILET SEAT SET TEMPERATURE "HIGH": 38 °C SETTING | | | | |
|---|---|---|---|---|---|
| | 600W DRIVE FOR REDUCING INRUSH CURRENT [Sec] | 1200 W DRIVE [Sec] | 1200 W → 600 W CONVERSION TEMPERATURE [°C] | 600 W DRIVE [Sec] | TARGET TEMPERATURE [°C] |
| 0～ 2 | | | | 16. 0 | 16. 5 |
| 2～ 4 | | | | 14. 0 | 16. 5 |
| 4～ 6 | | | | 12. 0 | 16. 5 |
| 6～ 8 | | | | 10. 0 | 16. 5 |
| 8～10 | | | | 8. 0 | 16. 5 |
| 10～12 | | | | 6. 0 | 16. 5 |
| 12～14 | | | | 4. 0 | 16. 5 |
| 14～16 | | | | 2. 0 | 16. 5 |
| 16～18 | 0. 2 | 6. 0 | 23. 0 | 8. 0 | 32. 3 |
| 18～20 | 0. 2 | 5. 1 | 23. 3 | 8. 2 | 33. 4 |
| 20～22 | 0. 2 | 4. 3 | 24. 2 | 8. 3 | 34. 4 |
| 22～24 | 0. 2 | 3. 4 | 26. 5 | 8. 4 | 35. 4 |
| 24～26 | 0. 2 | 2. 5 | 28. 3 | 8. 3 | 36. 6 |
| 26～28 | 0. 2 | 1. 6 | 29. 0 | 8. 3 | 37. 8 |
| 28～30 | | | | 9. 1 | 35. 2 |
| 30～32 | | | | 7. 3 | 35. 5 |
| 32～34 | | | | 5. 2 | 35. 8 |
| 34～36 | | | | 3. 5 | 36. 7 |
| 36～38 | | | | 2. 6 | 38. 3 |
| 38～ | | | | | |

TOILET SEAT DEVICE AND TOILET SEAT APPARATUS HAVING THE SAME

TECHNICAL FIELD

The present invention relates to a toilet seat device having a heating function and a toilet apparatus having the same.

BACKGROUND ART

There has been a known toilet seat device having a heating function in order to prevent a user from unpleasant feeling when the user sits on a cold toilet seat (for example, see Patent Document 1). FIG. 39 is a notched top plan view illustrating a part of a warm toilet seat according to Patent Document 1, and FIG. 40 is a sectional view taken along the line J-J in FIG. 39.

As shown in FIGS. 39 and 40, a warm toilet seat 900 has an upper casing 926 and a lower casing 927 made from synthetic resins. The upper casing 926 and the lower casing 927 are joined to each other. Inside the upper casing 926 and the lower casing 927, a radiation reflection plate 929, a lamp heater 930, a thermostat 931, a thermal fuse 932, and a thermistor 33 are provided.

The radiation reflection plate 929 is formed so as to coincide with a shape of the lower casing 927. The lamp heater 930 is disposed on the radiation reflection plate 929. Thermostat 931 and thermal fuse 932 are mounted on the radiation reflection plate 929 with a predetermined part of lamp heater 930 interposed therebetween.

As shown in FIG. 40, thermistor 933 is mounted on a place that is an inner side of the upper casing 926 and faces to the lamp heater 930.

In this warm toilet seat 900, an infrared sensor not shown in the drawings detects user's entry into a room. Accordingly, the lamp heater 930 is driven on the basis of a detection signal of the infrared sensor. Therefore, radiation energy from the lamp heater 930 is directly given to the upper casing 926 or indirectly given through the radiation reflection plate 929 to the upper casing 926, and thus the upper casing 926 radiates heat.

According to the warm toilet seat 900 of Patent Document 1 with such a configuration, it is not necessary to constantly drive the lamp heater 930, and thus it is possible to save energy.

In such a kind of warm toilet seat, which is another example, a seating section 2103 of a toilet seat 2102 having a cavity section 2101 formed therein is made from transparent polypropylene resin as shown in FIG. 41, whereby a radiated heat absorption layer 2104 is formed on a surface of the seating section 2103, and a lamp heater 2105 is formed on the cavity section 2101. The radiated heat from the lamp heater 2105 is transmitted through the seating section 2103 made from the transparent polypropylene resin, is converted to thermal energy in the radiated heat absorption layer 2104 on the surface thereof, and rise temperature of the seating section 2103. The heat is generated in the radiated heat absorption layer 2104 that is used to be in contact with the hips, and thus it is possible to warm the hips in a short time as compared with a thermal conduction heating type that employs a code heater and the like in the toilet seat 2102. In addition, a temperature control is performed by a thermostat 2106 that is disposed near the lamp heater 2105, and the temperature control prevents danger caused by abnormal heating by using a thermal fuse 2107.

Patent Document 1: Japanese Unexamined Patent Application Publication No. 2000-14598

Patent Document 2: Japanese Unexamined Patent Application Publication No. 2000-210230

DISCLOSURE OF THE INVENTION

Problems that the Invention is to Solve

In the warm toilet seat 900 according to Patent Document 1, temperature of the upper casing 926 is measured by thermistor 933 disposed on the inner side of the upper casing 926, and drive of the lamp heater 930 is controlled by a control section not shown in the drawings. With such a configuration, it is possible to warm the upper casing 926 to a predetermined temperature.

However, there is generated a time delay until the temperature of the upper casing 926 reaches the predetermined temperature by radiation energy from the lamp heater 930.

Accordingly, in a case where the drive of the lamp heater 930 is controlled on the basis of the measured temperature value obtained by thermistor 933, it is difficult to accurately control the temperature of the upper casing 926.

Therefore, for example, there is contrived a method of determining drive time of the lamp heater on the basis of room temperature and the measured temperature value of the seating section at the start time of applying current (see Patent Document 2).

In this case, relationship between the drive time of the lamp heater and an actual temperature of the seating section is previously calculated, the drive time of the lamp heater is controlled on the basis of the calculation result, and thus the temperature of the seating section can becomes close to the predetermined temperature (for example, user's set temperature).

However, in the warm toilet seat, there is a need to apply large current to the lamp heater in order that the lamp heater increases the temperature of the seating section in a short time. Because of this, overshoot is caused by temperature variance of the seating section. Hence, it is difficult to stabilize the temperature of the seating section at the set temperature in a short time.

In the known configuration as shown in FIG. 41, the lamp heater has good rapid heating performance because of good efficiency in electric power transformation and can rise temperature in a short time. However, since resistance of the lamp heater is low as much as 1/10 or less of rated electric power consumption when filament is in a cool down state (temperature of the filament is near room temperature of toilet), large inrush current flows at the beginning of applying current. As might be expected, the filament resistance reaches a rated resistance in a short time, and the inrush current is instantly suppressed. However, large current flows when current is applied to the toilet seat device and the other products (particularly, a heater) equipped in the toilet simultaneously.

Generally, since a house power wiring with respect to the toilet inside is not a large current wiring but a single power wiring, there are not usually provided a circuit breaker and an overcurrent breaker for dealing with the large current. In addition, generally, current is also applied to lighting apparatuses in the toilet from the same electric power wiring. For this reason, when current is applied to the lamp heater and heaters of the other products (for example, a hot water heater for heating washing water that washes a part of a human body) equipped in the toilet simultaneously, the circuit breaker is operated by overcurrent, and voltage drop is caused by resistance components of the house power wiring. Therefore, there have been problems of: supply voltage drop to a toilet seat device, other products equipped in toilet, and lighting in toilet; product performance deterioration of toilet seat device or other products equipped in toilet; and brightness down of indoor lighting.

It is an object of the invention to provide a toilet seat device capable of saving energy and accurately stabilizing the temperature of a seating section at a predetermined level in a short time, and a toilet apparatus having the same. In addition, it is an object of the invention to provide a toilet seat device that is convenient for use and can save more energy.

Means for Solving the Problem

In order to solve the known problems mentioned above, a toilet seat device according to the invention includes: a toilet seat section; a heating element for heating the toilet seat section; a human body sensing section for detecting a user; and a control section for controlling the heating element to be driven. When the human body sensing section detects a user, the control section drives the heating element during a first time period so as to increase temperature of the toilet seat section to first temperature along a first temperature gradient with first electric power, and then the control section drives the heating element during a second time period so as to increase temperature of the toilet seat section to second temperature, which is higher than the first temperature, along a second temperature gradient, which is lower than the first temperature gradient, with second electric power which is lower than the first electric power.

According to this toilet seat device, when the human body sensing section detects a user, the control section drives the heating element during a first time period so as to increase temperature of the toilet seat section to first temperature with first electric power. With such a configuration, the temperature of the toilet seat section increases along the first temperature gradient.

After the first electric power drives the heating element, the control section drives the heating element during a second time period so as to increase temperature of the toilet seat section to second temperature, which is higher than the first temperature, with second electric power that is lower than the first electric power. With such a configuration, the temperature of the toilet seat section increases along a second temperature gradient that is lower than the first temperature gradient.

When the temperature of the toilet seat section is measured and the heating element is driven on the basis of the measured temperature, there is generated delay time until the temperature of the heating element is transmitted to the toilet seat section. Therefore, it is difficult to accurately and rapidly control the temperature of the toilet seat section. Contrarily, according to the toilet device of the invention, the drive time of the heating element due to the first and second electric powers are previously set as the first and second time periods, respectively. Therefore, it is possible to accurately and rapidly control the temperature of the toilet seat section.

When the human body sensing section detects a user, the heating element is driven by the first and second electric powers. Therefore, when a user is not detected, it is not necessary to drive the heating element with the first and second electric powers that are necessary for rising the temperature of the toilet seat section. With such a configuration, electric power consumption is sufficiently reduced, and thus it is possible to save energy.

In addition, after the temperature of the toilet seat section is increased to the first temperature along the first temperature gradient, and then the temperature thereof is increased to the second temperature along the second temperature gradient that is lower than the first temperature gradient. With such a configuration, it is possible to reduce overshoot that is caused by temperature variance of the toilet seat section in the second temperature. Therefore, it is possible to easily stabilize the temperature of the toilet seat section at the second temperature.

In the toilet seat device according to the invention, when a human body is detected by human body sensing means in control means, electric power is supplied to the heating source for warming the toilet seat with a first duty ratio for constant time. Then, control operation is performed so that the toilet seat temperature reaches seatable temperature with a second duty ratio higher than the first duty ratio in a predetermined time.

With the configuration, it is possible to provide a toilet seat device that is convenient for use and can save more energy.

In the toilet seat device according to the invention, when a human body is detected by human body sensing means in the control means, electric power is supplied to the heating source for warming the toilet seat with a first duty ratio for constant time. Then, control operation is performed so that the toilet seat temperature reaches seatable temperature with a second duty ratio higher than the first duty ratio in a predetermined time. When seating of a human body is detected by the seating sensing means, control operation is performed on the heating source with a third duty ratio lower than the second duty ratio.

With the configuration, it is possible to provide a toilet seat device that is convenient for use and can save more energy.

In the toilet seat device according to the invention, when a human body is detected by human body sensing means in the control means, electric power is supplied to the heating source for warming the toilet seat with a plurality of duty ratios for constant time. Then, control operation is performed so that the toilet seat temperature reaches seatable temperature with a constant duty ratio higher than the plurality of duty ratios in a predetermined time.

With the configuration, it is possible to provide a toilet seat device that is convenient for use and can save more energy.

Advantage of the Invention

According to a toilet seat device and a toilet apparatus having the same of the invention, it is possible to save energy and accurately stabilize the temperature of a seating section at a predetermined level in a short time.

In addition, the toilet seat device according to the invention has a rapid heating function, and it is possible to provide a toilet seat device that is convenient for use and can save more energy.

BRIEF DESCRIPTION OF THE DRAWINGS

FIG. 8 is a diagram illustrating an example of heater control tables corresponding to predetermined toilet seat set temperatures (34° C., 36° C., and 38° C.).

FIG. 9 is a diagram illustrating an example of heater control tables corresponding to the predetermined toilet seat set temperatures (34° C., 36° C., and 38° C.).

DESCRIPTION OF REFERENCE NUMERALS AND SIGNS

Figure 1:
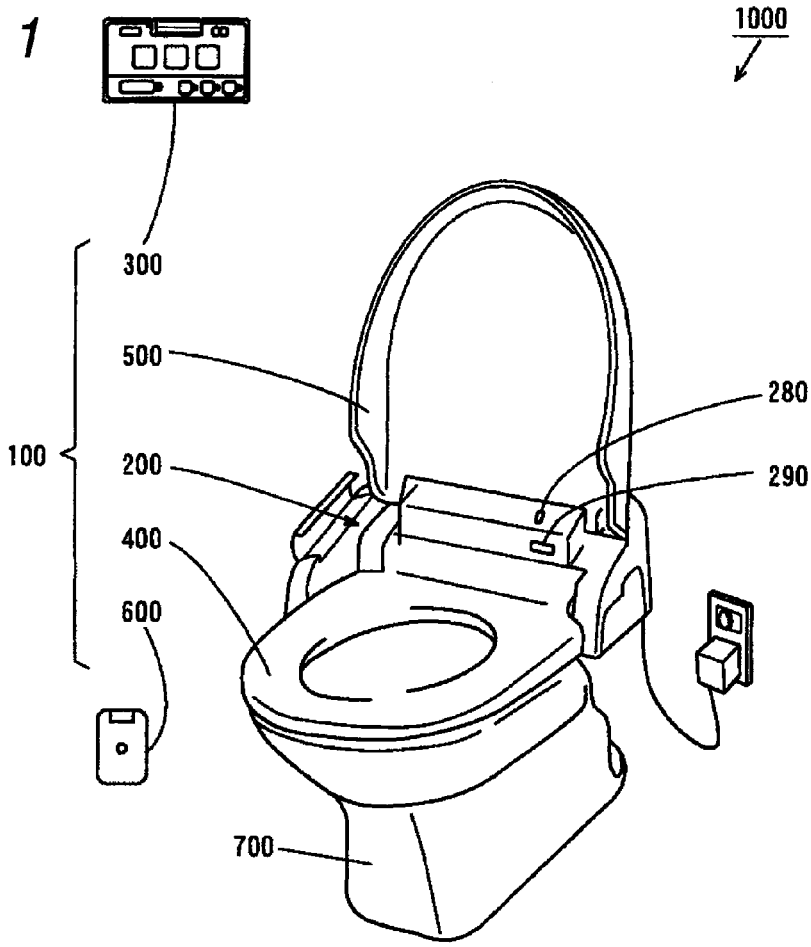
FIG. 1 is an exterior perspective view illustrating a toilet seat device and a toilet apparatus having the same according to an embodiment of the invention.

100: TOILET SEAT DEVICE
210: CONTROL UNIT
400: TOILET SEAT SECTION
410T: SEATING SECTION
411: THERMISTOR
480: LAMP HEATER
210: CONTROL UNIT
220: TEMPERATURE MEASUREMENT SECTION
290: SEAT SENSOR
600: ENTRY SENSOR
700: TOILET BOWL
1000: TOILET APPARATUS
2010: TOILET SEAT
2011: HEATING SOURCE
2012: HUMAN BODY SENSING MEANS
2013: CONTROL MEANS
2014: ROOM TEMPERATURE DETECTING MEANS
2015: TOILET SEAT TEMPERATURE DETECTING MEANS
3010: TOILET SEAT
3011: HEATING SOURCE
3012: HUMAN BODY SENSING MEANS
3013: SEATING SENSING MEANS
3014: CONTROL MEANS
3015: ROOM TEMPERATURE DETECTING MEANS
3016: TOILET SEAT TEMPERATURE DETECTING MEANS
4010: TOILET SEAT
4011: HEATING SOURCE
4012: HUMAN BODY SENSING MEANS
4013: CONTROL MEANS
4014: ROOM TEMPERATURE DETECTING MEANS
4015: TOILET SEAT TEMPERATURE DETECTING MEANS

BEST MODE FOR CARRYING OUT THE INVENTION (1) A toilet seat device according to a first aspect of the invention includes: a toilet seat section; a heating element for heating the toilet seat section; a human body sensing section for detecting a user; and a control section for controlling the heating element to be driven. When the human body sensing section detects a user, the control section drives the heating element during a first time period so as to increase temperature of the toilet-seat section to first temperature along a first temperature gradient with first electric power, and then the control section drives the heating element during a second time period so as to increase temperature of the toilet seat section to second temperature, which is higher than the first temperature, along a second temperature gradient, which is lower than the first temperature gradient, with second electric power which is lower than the first electric power.

According to this toilet seat device, when the human body sensing section detects a user, the control section drives the heating element during a first time period so as to increase temperature of the toilet seat section to first temperature with first electric power. With such a configuration, the temperature of the toilet seat section increases along the first temperature gradient.

After the first electric power drives the heating element, the control section drives the heating element during a second time period so as to increase temperature of the toilet seat section to second temperature, which is higher than the first temperature, with second electric power that is lower than the first electric power. With such a configuration, the temperature of the toilet seat section increases along a second temperature gradient that is lower than the first temperature gradient.

When the temperature of the toilet seat section is measured and the heating element is driven on the basis of the measured temperature, there is generated delay time until the temperature of the heating element is transmitted to the toilet seat section. Therefore, it is difficult to accurately and rapidly control the temperature of the toilet seat section. Meanwhile, according to the toilet device of the invention, the drive time of the heating element due to the first and second electric powers are previously set as the first and second time periods, respectively. Therefore, it is possible to accurately and rapidly control the temperature of the toilet seat section.

When the human body sensing section detects a user, the heating element is driven by the first and second electric powers. Therefore, when a user is not detected, it is not necessary to drive the heating element with the first and second electric powers that is necessary for rising the temperature of the toilet seat section. With such a configuration, electric power consumption is sufficiently reduced, and thus it is possible to save energy.

In addition, after the temperature of the toilet seat section is increased to the first temperature along the first temperature gradient, and then the temperature thereof is increased to the second temperature along the second temperature gradient that is lower than the first temperature gradient. With such a configuration, it is possible to reduce overshoot that is caused by temperature variance of the toilet seat section in the second temperature. Therefore, it is possible to easily stabilize the temperature of the toilet seat section at the second temperature.

In addition, the second temperature is set as temperature that makes a user feel comfortable, and thus a user can comfortably sit on the toilet seat section.

(2) In the configuration of the toilet seat device according to the first aspect of the invention, a toilet seat device according to a second aspect of the invention further includes: a toilet seat temperature measuring device for measuring the temperature of the toilet seat section, and a memory section for storing correspondence relationship between the first and second time periods and the temperature measured by the toilet seat temperature measuring device. When the human body sensing section detects a user, the control section reads out the corresponding first and second time periods from the memory section on the basis of the temperature measured by the toilet seat temperature measuring device, and the control section drives the heating element on the basis of the first and second time periods.

In this case, when the human body sensing section detects a user, the corresponding first and the second time periods are read from the memory section on the basis of the temperature measured by the toilet seat temperature measuring device. Then, the control section drives the heating element on the basis of the first and second time periods.

With such a configuration, it is possible to drive the heating element on the basis of the first and second time periods corresponding to the temperature around the toilet seat device. Accordingly, even when atmospheric temperature changes, it is possible to increase the temperature of the toilet seat section to the first and second temperatures.

In addition, when the human body sensing section detects a user, the heating element is not driven by the first and second electric powers. Accordingly, when the human body sensing section detects a user, the temperature measured by the toilet seat temperature measuring device is not changed and stabilized. Therefore, the heating element is driven on the basis of the first and second time periods, and thus it is possible to increase the temperature of the toilet seat section to the first and second temperatures.

(3) In the configuration of the toilet seat device according to the second aspect of the invention, a toilet seat device according to a third aspect of the invention is configured so that the control section drives the heating element with the second electric power when the temperature measured by the toilet seat temperature measuring device reaches a predetermined third temperature before the elapse of first time period.

In this case, when the temperature measured by the toilet seat temperature measuring device reaches the predetermined third temperature before the elapse of first time period, the control section drives the heating element with the second electric power.

Here, the third temperature is set as temperature measured by the toilet seat temperature measuring device at the time in which the temperature of the toilet seat section reaches the first temperature with the first electric power to the heating element to be driven.

With such a configuration, it is possible to prevent the toilet seat section from overheat so that the temperature thereof does not exceed the first temperature when the heating element is driven on the basis of the first time period.

(4) In the configuration of the toilet seat device according to any one of the first to third aspects of the invention, a toilet seat device according to a fourth aspect of the invention is configured so that the control section drives the heating element with the first electric power by applying alternating current throughout entire cycle periods, and the control section drives the heating element with the first electric power by applying alternating current throughout a predetermined number of half cycle periods.

In this case, the alternating current throughout the entire cycle periods or the predetermined number of half cycle periods is applied to the heating element when the heating element is driven by the first and second electric powers. Therefore, the current applied to the heating element varies like a sine curve. With such a configuration, the current applied to the heating element does not include harmonic components. Accordingly, occurrence of noise is sufficiently reduced.

(5) In the configuration of the toilet seat device according to the second or third aspect of the invention, a toilet seat device according to a fifth aspect of the invention is configured so that the control section drives the heating element with third electric power, which is lower than the first and second electric powers, so as to constantly maintain the temperature of the toilet seat section at the second temperature after the elapse of second time period.

In this case, the control section drives the heating element with third electric power, which is lower than the first and second electric powers, so as to constantly maintain the temperature of the toilet seat section at the second temperature, after the elapse of second time period.

In this manner, the temperature of the toilet section is constantly maintained at the second temperature, and thus a user can comfortably sit on the toilet seat section that is maintained at proper temperature.

In addition, the heating element is driven by the third electric power that is lower than the first and second electric powers, and thus it is possible to reduce electric power consumption and maintains the temperature of the toilet seat section at the second temperature.

(6) In the configuration of the toilet seat device according to the fifth aspect of the invention, a toilet seat device according to a sixth aspect of the invention is configured so that the control section drives the heating element with the third electric power when the temperature measured by the toilet seat temperature measuring device reaches a predetermined fourth temperature, before the elapse of second time period.

In this case, the control section drives the heating element with the third electric power when the temperature measured by the toilet seat temperature measuring device reaches a predetermined fourth temperature, before the elapse of second time period.

Here, the fourth temperature is set as temperature measured by the toilet seat temperature measuring device at the time in which the temperature of the toilet seat section reaches the second temperature with the second electric power to the heating element to be driven.

With such a configuration, it is possible to prevent the toilet seat section from overheat so that the temperature thereof does not exceed the second temperature when the heating element is driven on the basis of the second time period.

(7) In the configuration of the toilet seat device according to the fifth or sixth aspect of the invention, a toilet seat device according to a seventh aspect of the invention is configured so that the control section drives the heating element with the third electric power by applying alternating current throughout a predetermined number of quarter or less cycle periods.

In this case, since the current applied to the heating element is small when the heating element is driven by the third electric power, there is small effect from harmonic components that is caused by an alternating-current control. Accordingly, occurrence of noise caused by the current control is reduced.

(8) In the configuration of the toilet seat device according to any one of the first to seventh aspects of the invention, a toilet seat device according to an eighth aspect of the invention is configured so that the control section drives the heating element with electric power, which is lower than the first electric power, immediately before driving the heating element with the first electric power.

In this case, the control section drives the heating element with electric power, which is lower than the first electric power, immediately before driving the heating element with the first electric power, and thus it is possible to sufficiently prevent occurrence of large inrush current.

(9) In the configuration of the toilet seat device according to any one of the first to eighth aspect of the invention, a toilet seat device according to a ninth aspect of the invention further includes a seating sensing section for detecting user's seating state on the toilet seat section. When the seating sensing section detects user's seating on the toilet seat section, the control section drives the heating element so as to decrease the temperature of the toilet seat section.

In this case, the control section drives the heating element so as to decrease the temperature of the toilet seat section when the seating sensing section detects user's seating on the toilet seat section. Therefore, it is possible to prevent a user from suffering low temperature burn even when the user sits on the toilet seat section in a long time.

(10) In the configuration of the toilet seat device according to any one of the first to ninth aspects of the invention, a toilet seat device according to a tenth aspect of the invention is configured so that the second temperature is the temperature, which is previously set by a user, of the toilet seat section, and the control section drives the heating element so as to increase the temperature of the toilet seat section higher than the second temperature at the time of user's seating on the toilet seat section.

In this case, a user can previously set the temperature of the toilet seat to be comfortable temperature. Here, the heating element is driven so that the temperature of the toilet seat section becomes higher than the second temperature. In this manner, a user can feel like the substantially same temperature as the second temperature that is set by a user himself at the time of seating on the toilet seat section.

(11) In the configuration of the toilet seat device according to any one of the first to tenth aspects of the invention, a toilet seat device according to an eleventh aspect of the invention is configured so that the toilet seat section is made of aluminum.

In this case, the toilet seat section is made of aluminum that has higher thermal conductivity than resin. Therefore, heat applied to the toilet seat section by driving the heating element is sufficiently transmitted to the entire toilet seat section.

(12) In the configuration of the toilet seat device according to any one of the first to eleventh aspects of the invention, a toilet seat device according to a twelfth aspect of the invention is configured so that the heating element is a lamp heater. In this case the lamp heater can rapidly increase the toilet section by radiating energy.

(13) A toilet apparatus according to a thirteenth aspect of the invention includes a toilet bowl and the toilet seat device according to any one of the first to twelfth aspects of the invention.

In this toilet apparatus, the toilet seat device is mounted on the toilet bowl. In this toilet device, when the human body sensing section detects a user, the control section drives the heating element during a first time period so as to increase temperature of the toilet seat section to first temperature with first electric power. With such a configuration, the temperature of the toilet seat section increases along the first temperature gradient.

After the first electric power drives the heating element, the control section drives the heating element during a second time period so as to increase temperature of the toilet seat section to second temperature, which is higher than the first temperature, with second electric power that is lower than the first electric power. With such a configuration, the temperature of the toilet seat section increases along a second temperature gradient that is lower than the first temperature gradient.

When the temperature of the toilet seat section is measured and simultaneously the heating element is driven on the basis of the measured temperature, there is generated delay time until the temperature of the heating element is transmitted to the toilet seat section. Therefore, it is difficult to accurately and rapidly control the temperature of the toilet seat section. Contrarily, according to the toilet device of the invention, the drive time of the heating element due to the first and second electric powers are previously set as the first and second time periods, respectively. Therefore, it is possible to accurately and rapidly control the temperature of the toilet seat section.

When the human body sensing section detects a user, the heating element is driven by the first and second electric powers. Therefore, when a user is not detected, it is not necessary to drive the heating element with the first and second electric powers that is necessary for rising the temperature of the toilet seat section. With such a configuration, electric power consumption is sufficiently reduced, and thus it is possible to save energy.

In addition, after the temperature of the toilet seat section is increased to the first temperature along the first temperature gradient, and then the temperature thereof is increased to the second temperature along the second temperature gradient that is lower than the first temperature gradient. With such a configuration, it is possible to reduce overshoot that is caused by temperature variance of the toilet seat section in the second temperature. Therefore, it is possible to easily stabilize the temperature of the toilet seat section at the second temperature.

In addition, the second temperature is set as temperature that makes a user feel comfortable, and thus a user can comfortably sit on the toilet seat section.

(14) A fourteenth aspect of the invention includes: a heating source for warming the toilet seat; human body sensing means; and control means for controlling the heating source and the human body sensing means. When a human body is sensed, the control means performs a control operation so that the toilet seat temperature reaches seatable temperature in a predetermined time by employing a second duty ratio that is higher than the first duty ratio after electric power is supplied to the heating source with a first duty ratio for constant time, and thus it is possible to suppress large inrush current. Therefore, there is no problem that the circuit breaker is operated by overcurrent, or voltage drop is caused by resistance components of the house power wiring. Thus, there is no supply voltage drop to a toilet seat device, other products equipped in toilet, and lighting in toilet, no product performance deterioration of toilet seat device or other products equipped in toilet, and no brightness down of indoor lighting. As a result, it is possible to provide a toilet seat device that is convenient for use and can save more energy.

(15) According to the fourteenth aspect of the invention, a fifteenth aspect of the invention further includes a room temperature detecting means, and the predetermined time is determined in accordance with room temperature. Therefore, the temperature of the toilet seat reaches seatable temperature in a minimum time for necessary, and thus it is possible to provide a convenient toilet seat device. In addition, since current is not unnecessarily applied to the heating source, it is possible to achieve a toilet seat device that can save more energy.

(16) According to the fourteenth aspect of the invention, a sixteenth aspect of the invention further includes a toilet seat temperature detecting means for detecting toilet seat temperature, and the predetermined time is determined in accordance with the toilet seat temperature. Therefore, the temperature of the toilet seat reaches seatable temperature in a minimum time for necessary, and thus it is possible to provide a convenient toilet seat devices. In addition, since current is not unnecessarily applied to the heating source, it is possible to achieve a toilet seat device that can save more energy.

(17) According to the sixteenth aspect of the invention, a seventeenth aspect of the invention is configured so that the toilet seat temperature detecting means detects temperature in the toilet seat. Therefore, the temperature of the toilet seat reaches seatable temperature in a minimum time for necessary, it is possible to provide a convenient toilet seat device. In addition, since current is not unnecessarily applied to the heating source, it is possible to achieve a toilet seat device that can save more energy.

(18) According to any one of the fourteenth to the seventeenth aspects of the invention, a seventeenth aspect of the invention is configured so that electric power is supplied with duty ratio that maintains the toilet seat temperature at a set temperature, after the elapse of predetermined time. Therefore, since current is not unnecessarily applied to the heating source, it is possible to achieve a toilet seat device that can save more energy.

(19) A nineteenth aspect of the invention includes: a heating source for warming the toilet seat; seating sensing means; human body sensing means; and control means for controlling the heating source, the seating sensing means, and the human body sensing means. When a human body is sensed, the control means performs a control operation so that the toilet seat temperature reaches seatable temperature in a predetermined time by employing a second duty ratio that is higher than the first duty ratio, the electric power is applied with third duty ratio, which is lower than the second duty ratio after electric power is supplied to the heating source with a first duty ratio for constant time, and thus it is possible to suppress large inrush current directly after starting electric power supply. Therefore, there is no problem that the circuit breaker is operated by overcurrent, or voltage drop is caused by resistance components of the house power wiring. Thus, there is no supply voltage drop to a toilet seat device, other products equipped in toilet, and lighting in toilet, no product performance deterioration of toilet seat device or other products equipped in toilet, and no brightness down of indoor lighting. In addition, the toilet seat is covered by the human body when a human body is sitting on the toilet seat, so that heat retaining property increases and body temperature warms the toilet seat, and thus it is possible to minimize useless electric power by lowering duty ratio. As a result, it is possible to provide a toilet seat device that is convenient for use and can save more energy.

(20) According to the nineteenth aspect of the invention, a twentieth aspect of the invention further includes a room temperature detecting means, and the predetermined time is determined in accordance with room temperature. Therefore, the temperature of the toilet seat reaches seatable temperature in a minimum time for necessary, and thus it is possible to provide a convenient toilet seat device. In addition, since current is not unnecessarily applied to the heating source, it is possible to achieve a toilet seat device that can save more energy.

(21) According to the nineteenth aspect of the invention, a twenty first aspect of the invention further includes a toilet seat temperature detecting means for detecting toilet seat temperature, and the predetermined time is determined in accordance with the toilet seat temperature. Therefore, the temperature of the toilet seat reaches seatable temperature in a minimum time for necessary, and thus it is possible to provide a convenient toilet seat device. In addition, since current is not unnecessarily applied to the heating source, it is possible to achieve a toilet seat device that can save more energy.

(22) According to the twenty first aspect of the invention, a twenty second aspect of the invention is configured so that the toilet seat temperature detecting means detects temperature in the toilet seat. Therefore, the temperature of the toilet seat reaches seatable temperature in a minimum time for necessary, it is possible to provide a convenient toilet seat device. In addition, since current is not unnecessarily applied to the heating source, it is possible to achieve a toilet seat device that can save more energy.

(23) According to any one of the nineteenth to the twenty second aspects of the invention, a twenty third aspect of the invention is configured so that electric power is supplied with duty ratio that maintains the toilet seat temperature at a set temperature, after the elapse of predetermined time. Therefore, since current is not unnecessarily applied to the heating source, it is possible to achieve a toilet seat device that can save more energy.

(24) A twenty fourth aspect of the invention includes: a heating source for warming the toilet seat; human body sensing means; and control means for controlling the heating source and the human body sensing means. When a human body is detected by human body sensing means, the control means controls to supply electric power to the heating source for warming the toilet seat with a plurality of duty ratios for constant time. Then, the control means performs a control operation so that the toilet seat temperature reaches seatable temperature with a constant duty ratio higher than the plurality of duty ratios in a predetermined time, and thus it is possible to suppress large inrush current. Therefore, there is no problem that the circuit breaker is operated by overcurrent, or voltage drop is caused by resistance components of the house power wiring. Thus, there is no supply voltage drop to a toilet seat device, other products equipped in toilet, and lighting in toilet, no product performance deterioration of toilet seat device or other products equipped in toilet, and no brightness down of indoor lighting. As a result, it is possible to provide a toilet seat device that is convenient for use and can save more energy.

(25) According to the twenty fourth aspect of the invention, a twenty fifth aspect of the invention is configured so that the plurality of duty ratios stepwise increases. Therefore, the temperature of the toilet seat reaches seatable temperature in a minimum time for necessary, and thus it is possible to provide a convenient toilet seat device. In addition, since current is not unnecessarily applied to the heating source, it is possible to achieve a toilet seat device that can save more energy.

(26) According to the twenty fourth aspect of the invention, a twenty sixth aspect of the invention is configured so that the plurality of duty ratios continuously increase. Therefore, the temperature of the toilet seat reaches seatable temperature in a minimum time for necessary, and thus it is possible to provide a convenient toilet seat device. In addition, since current is not unnecessarily applied to the heating source, it is possible to achieve a toilet seat device that can save more energy.

(27) According to any one of the twenty fourth to twenty sixth aspects of the invention, a twenty seventh aspect of the invention further includes a room temperature detecting means, and the predetermined time is determined in accordance with room temperature. Therefore, the temperature of the toilet seat reaches seatable temperature in a minimum time for necessary, and thus it is possible to provide a convenient toilet seat device. In addition, since current is not unnecessarily applied to the heating source, it is possible to achieve a toilet seat device that can save more energy.

(28) According to any one of the twenty fourth to twenty sixth aspects of the invention, a twenty eighth aspect of the invention further includes a toilet seat temperature detecting means for detecting toilet seat temperature, and the predetermined time is determined in accordance with the toilet seat temperature. Therefore, the temperature of the toilet seat reaches seatable temperature in a minimum time for necessary, and thus it is possible to provide a convenient toilet seat device. In addition, since current is not unnecessarily applied to the heating source, it is possible to achieve a toilet seat device that can save more energy.

(29) According to the twenty eighth aspect of the invention, a twenty ninth aspect of the invention is configured so that the toilet seat temperature detecting means detects temperature in the toilet seat. Therefore, the temperature of the toilet seat reaches seatable temperature in a minimum time for necessary, it is possible to provide a convenient toilet seat device. In addition, since current is not unnecessarily applied to the heating source, it is possible to achieve a toilet seat device that can save more energy.

(30) According to any one of the twenty fourth to twenty ninth aspects of the invention, a thirtieth aspect of the invention is configured so that electric power is supplied with duty ratio for maintaining the toilet seat temperature at a set temperature, after the elapse of predetermined time. Therefore, since current is not unnecessarily applied to the heating source, it is possible to achieve a toilet seat device that can save more energy.

Hereinafter, a nozzle device according to an embodiment of the invention and a hygiene washing apparatus will be described with reference to drawings.

Embodiment 1

(1) Exterior View of Toilet Seat Device and Toilet Apparatus Having the Same

FIG. 1 is an exterior perspective view illustrating a toilet seat device and a toilet apparatus having the same according to an embodiment of the invention. As shown in FIG. 1, the toilet apparatus 1000 includes a toilet seat device 100 and a toilet bowl 700, and the apparatus is provided in a toilet.

In the toilet apparatus 1000, a toilet seat device 100 is mounted on the toilet bowl 700. The toilet seat device 100 has a heating function, and is constituted of a main body section 200, a remote control device 300, a toilet seat section 400, a cover section 500, and an entry sensor 600.

The toilet seat section 400 and cover section 500 is mounted on the main body section 200 so as to be freely openable. In addition, a washing water supply tool and a seat sensor 290 is provided in the main body section 200, and the control section to be described later is built therein.

In the embodiment, a lamp heater is built in the toilet seat section 400. Detailed description will be given later.

The washing water supply tool of the main body section 200 that is not shown in the drawings is connected to a water supply pipe, and the tool supplied washing water to the toilet bowl 700. The seat sensor 290 is, for example, a reflection type infrared sensor. In this case, the seat sensor 290 senses that a user is on the toilet seat section 400 when detecting infrared rays reflected from a human body.

In addition, a notice LED 280 is provided on the upper face side of the main body section 200. The notice LED 280 is turned on when temperature of the toilet seat section 400 reaches toilet seat set temperature to be described later.

A plurality of switches are provided on the remote control device 300. The remote control device 300 is attached to, for example, a place where a user sitting on the toilet seat section 400 to be seated can manipulate.

The entry sensor 600 is attached to, for example, an entrance of toilet. The entry sensor 600 is, for example, a reflection type infrared sensor. In this case, the entry sensor 600 senses user's entry into the toilet room when detecting infrared rays reflected from a human body.

The control section of the main body section 200 controls a drive of the lamp heater to be described later that is built in the toilet seat section 400, on the basis of signals received from the seat sensor 290, the remote control device 300, and the entry sensor 600.

In addition, the control section of the main body section 200 also controls a washing water supply tool (which is not shown in the drawings), and a deodorizing device (which is not shown in the drawings) and warm air sending device (which is not shown in the drawings) that are disposed on the main body section 200.

(2) Configuration of Remote Control Device

Figure 2:
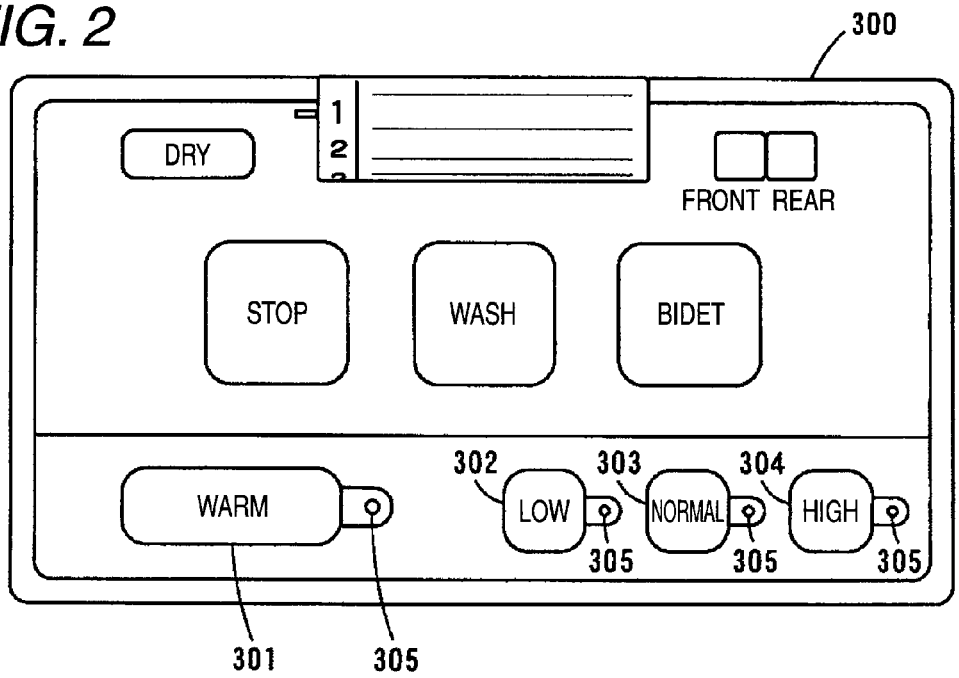
FIG. 2 is a schematic view illustrating an example of a remote control device in FIG. 1.

FIG. 2 is a schematic view illustrating an example of a remote control device 300 in FIG. 1.

As shown in FIG. 2, the remote control device 300 includes a warm switch 301, a plurality of temperature adjustment switches 302, 303, and 304 and a plurality of LEDs (a light emitting diode) 305.

A user operates the warm switch 301 and the plurality of temperature adjustment switches 302, 303, and 304 by pressing them.

Then, the remote control device 300 transmits a predetermined signal by wireless to the control section disposed on the main body section 200 of the toilet seat device 100 to be described later. The control section of the main body section 200 controls the drive of the lamp heater to be described later, by receiving the predetermined signal that is transmitted by wireless from the remote control device 300.

When a user uses the heating function like winter season, the heating function of the toilet seat device 100 is turned on by previously pressing the warm switch 301. In this state, the temperature of the toilet seat section 400 is set as low temperature (for example, 34° C.) when the temperature adjustment switch 302 is pressed, the temperature of the toilet seat section 400 is set as intermediate temperature (for example, 36° C.) when the temperature adjustment switch 303 is pressed, and the temperature of the toilet seat section 400 is set as high temperature (for example, 38° C.) when the temperature adjustment switch 304 is pressed.

In addition, when the user does not use the heating function like summer season, the heating function of the toilet seat device 100 is turned off by pressing the warm, switch 301.

Hereinafter, the temperature of the toilet seat section 400 that is set by the temperature adjustment switches 302 to 304 is referred to as toilet seat set temperature.

The plurality of LEDs 305 are disposed corresponding to the warm switch 301 and the plurality of temperature adjustment switches 302, 303, and 304, respectively. The plurality of LEDs 305 is turned on by pressing the warm switch 301 and the plurality of temperature adjustment switches 302, 303, and 304.

(3) Configuration of Toilet Seat Device

Figure 3:
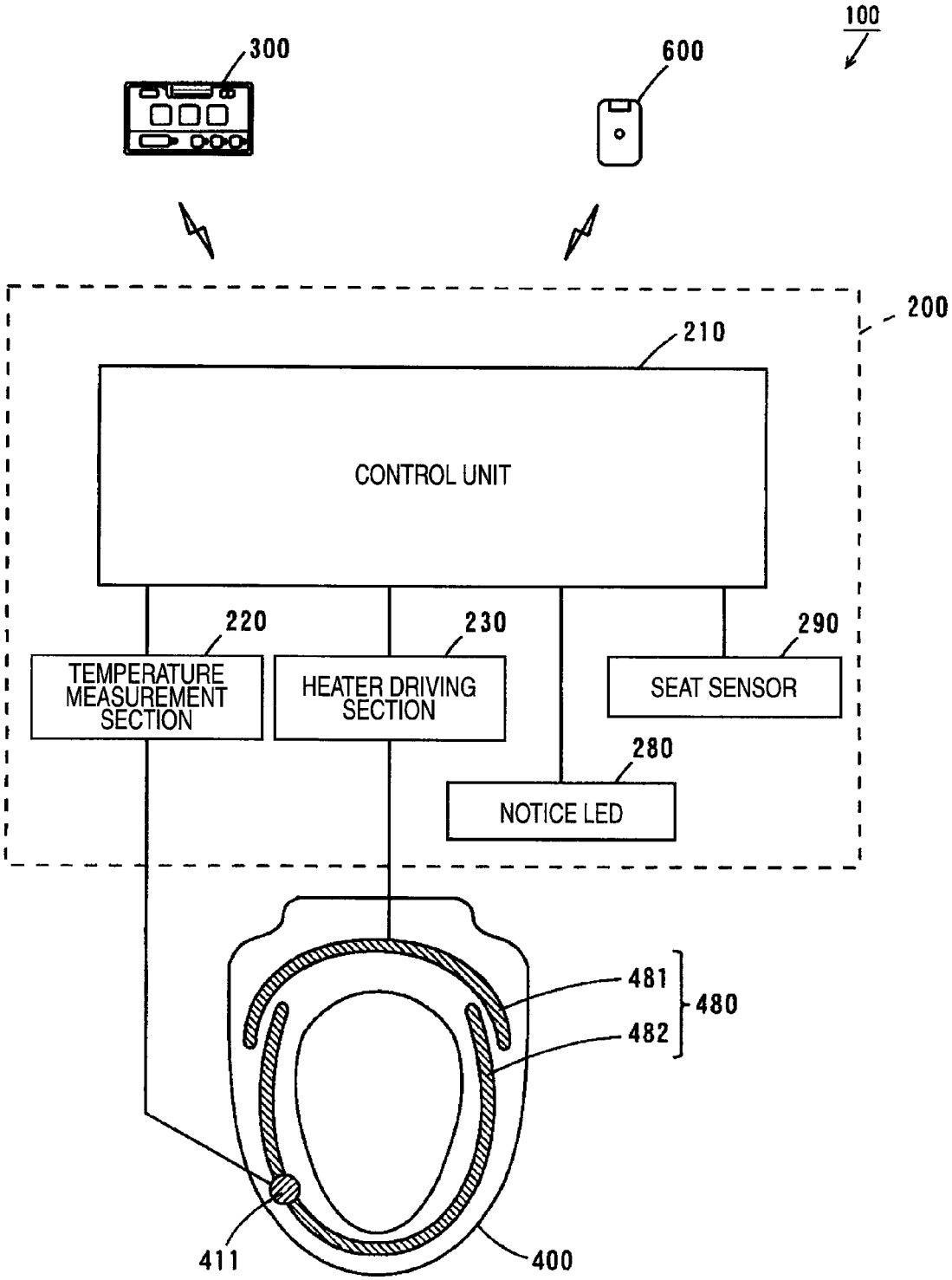
FIG. 3 is a schematic view illustrating a configuration of a toilet seat device according to an embodiment of the invention.

FIG. 3 is a schematic view illustrating a configuration of a toilet seat device 100 according to an embodiment of the invention. As described above, the toilet seat device 100 includes the main body section 200, the remote control device 300, the toilet seat section 400, and the entry sensor 600.

As shown in FIG. 3, the main body section 200 includes a control section 210, a temperature measurement section 220, a heater driving section 230, a notice LED 280, and a seat sensor 290.

In addition, the toilet seat section 400 includes a lamp heater 480 and a thermistor 411. The lamp heater 480 includes a rear lamp heater 481 and a front lamp heater 482.

The control section 210 is formed of, for example, micro computers. The control section 210 includes: a judgment section for judging user's entry, temperature of the toilet seat section 400, and the like; a timer section having a timer function; a memory section for storing various information, and A duty ratio switching circuit for controlling an operation of the heater driving section 230.

The temperature measurement section 220 of the main body section 200 is connected to thermistor 411 of the toilet seat section 400. With such a configuration, the temperature measurement section 220 measures the temperature of the toilet seat section 400 on the basis of a signal outputted from thermistor 411. Hereinafter, the temperature of the toilet seat section 400 measured by the temperature measurement section 220 via thermistor 411 is referred to as a measured temperature value.

In addition, the heater driving section 230 of the main body section 200 is connected to the lamp heater 480 of the toilet seat section 400. With such a configuration, the heater driving section 230 drives the lamp heater 480.

In the embodiment, the toilet seat device 100 operates as follows.

First, an operation of initial setting will be described. A user presses the warm switch 301 (FIG. 2) of the remote control device 300, and thereby a signal for turning on the heating function is transmitted to the control section 210 of the main body section 200. With such a configuration, the control section 210 controls the heater driving section 230, and thereby the lamp heater 480 is driven. With such a configuration, the temperature of the toilet seat section 400 is adjusted so as to be at, for example, 18° C. The temperature at that time is referred to as standby temperature.

Here, a user presses any one of the temperature adjustment switches 302, 303, and 304 (FIG. 2) of the remote control device 300, and thereby the toilet seat set temperature is transmitted to the control section 210. The control section 210 stores the toilet seat set temperature information received from the remote control device 300 in the memory section.

For example, when the temperature adjustment switch 302 is pressed by a user, the toilet seat set temperature is set as 34° C. and is stored in the memory section. In addition, when the temperature adjustment switch 303 is pressed by a user, the toilet seat set temperature is set as 36° C. and is stored in the memory section. Further, when the temperature adjustment switch 304 is pressed by a user, the toilet seat set temperature is set as 38° C. and is stored in the memory section.

When a user enters the toilet, the entry sensor 600 senses user's entry. With such a configuration, a signal representing the user's entry is transmitted to the control section 210.

Next, an operation at the time of general use will be described. The judgment section of the control section 210 judges user's entry into a toilet on the basis of the signal from the entry sensor 600. Accordingly, the judgment section selects a specified heater control pattern for driving the lamp heater 480 on the basis of the measured temperature value of the toilet seat section 400 and a heater control table to be described later that is stored in the memory section.

The duty ratio switching circuit controls the operation of the heater driving section 230 on the basis of the selected heater control pattern and time information that is obtained by the timer section.

With such a configuration, the lamp heater 480 is driven by the heater driving section 230, and the temperature of the toilet seat section 400 is instantly increased to the toilet seat set temperature.

Detailed description of the operation of control section 210, the heater control pattern for driving the lamp heater 480, and the heater control table will be given later.

Figure 4:
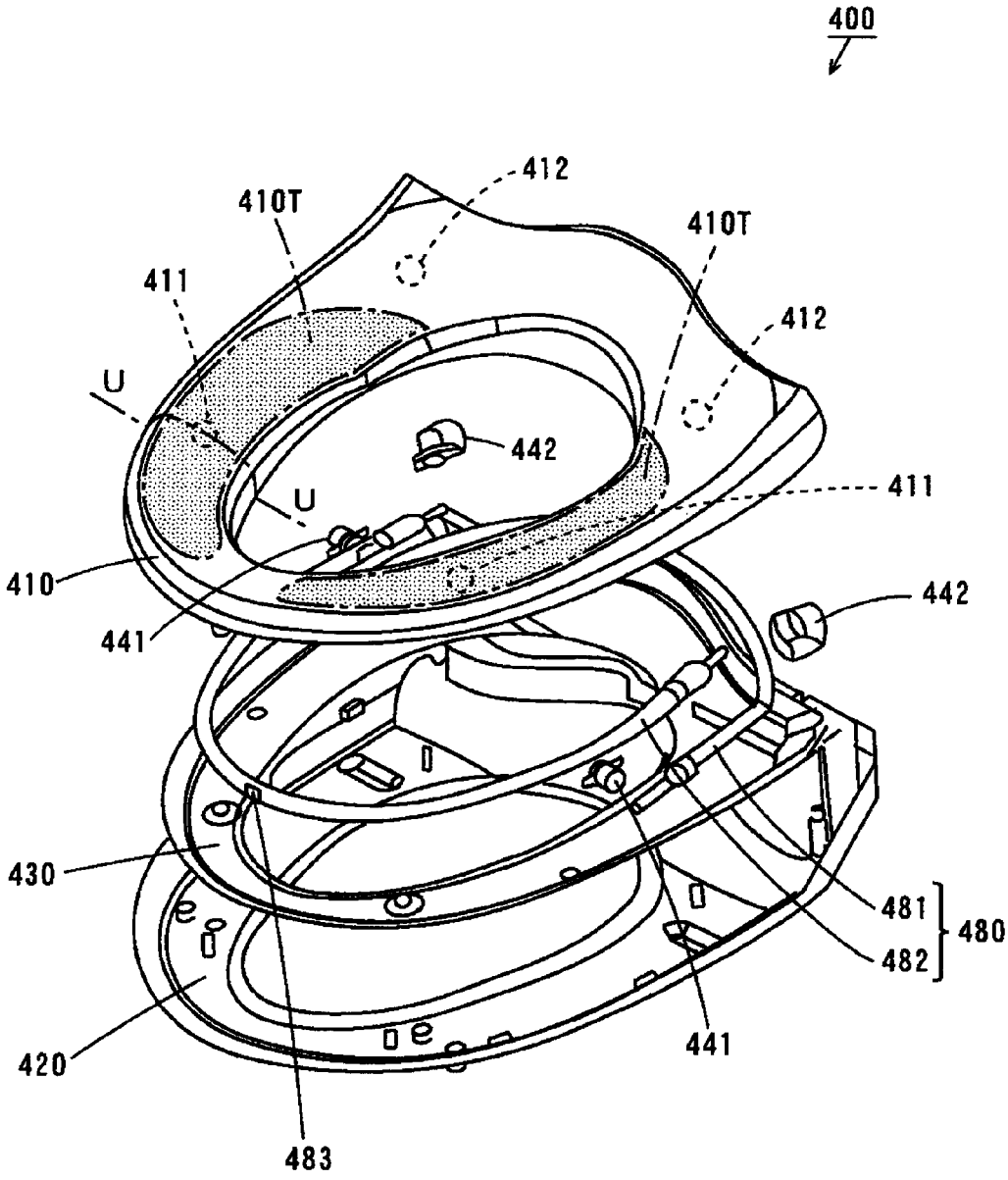
FIG. 4 is a diagram illustrating a detailed structure of the toilet seat section in FIG. 1.
Figure 5:
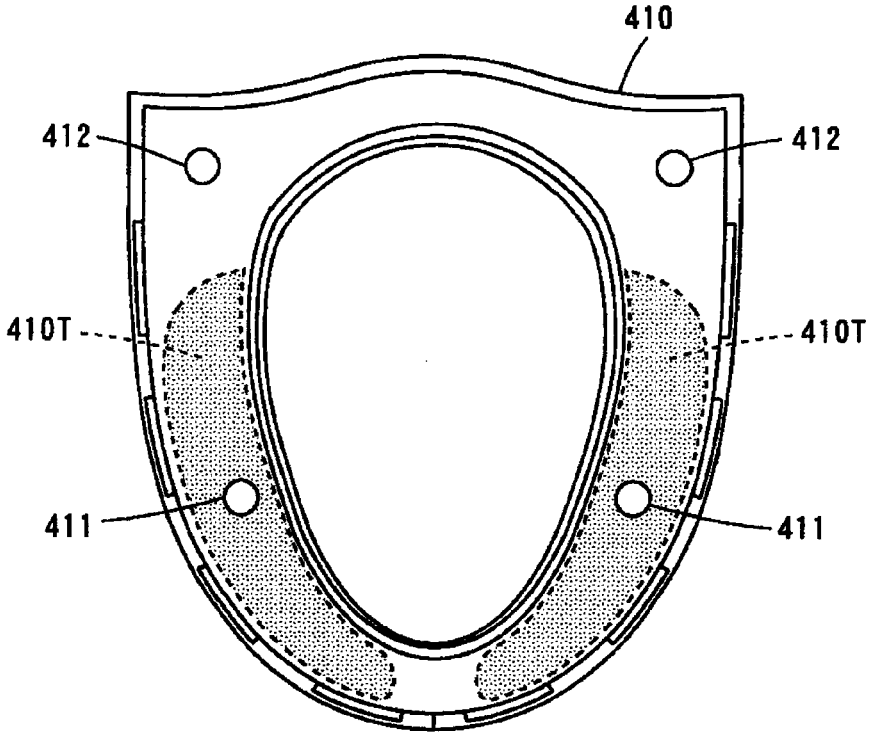
FIG. 5 is a diagram illustrating a detailed structure of the toilet seat section in FIG. 1.
Figure 6:
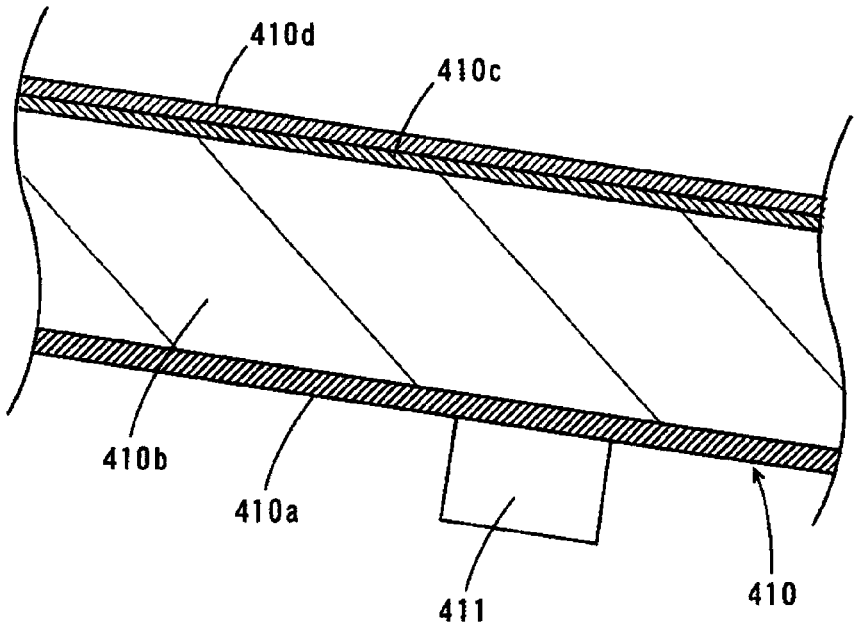
FIG. 6 is a diagram illustrating a detailed structure of the toilet seat section in FIG. 1.

(4) Details of Toilet Seat Section Structure (4-a) Structure of Toilet Seat Section FIGS. 4 to 7 are diagrams illustrating a detailed structure of the toilet seat section 400 in FIG. 1. FIG. 4 is an exploded perspective view of the toilet seat section 400. FIG. 5 is a view of an upper toilet seat casing 410 as viewed from the lower side. FIG. 6 is an enlarged sectional view of the upper toilet seat casing 410 taken along the line U-U in FIG. 4.

As shown in FIG. 4, the toilet seat section 400 includes the upper toilet seat casing 410 made of aluminum and a lower toilet seat casing 420 made of synthetic resin.

As shown in the portion drawn by the chain line, a part of upper face of the upper toilet seat casing 410 user's seating section 410T.

As shown in FIGS. 4 and 5, two thermistors 411 are mounted on an area of the seating section 410T in a lower face side of the upper toilet seat casing 410. In addition, other two thermistors 412 are mounted on the other area.

In addition, only one thermistor 411 may be used as thermistor disposed on the area of the seating section 410T. In addition, only one thermistor 412 may be used as thermistor disposed on the other area.

As shown in FIG. 6, the upper toilet seat casing 410 is manufactured by forming various layers on the upper and lower faces of aluminum layer 410*b* having excellent thermal conductivity. In addition, thermal conductivity of aluminum is about 237 W/n·K.

The lower face of the aluminum layer 410*b* is coated with black pigments including carbon and the like. With such a configuration, a radiation absorption layer 410*a* having a black color for efficiently absorbing radiation energy is formed on the lower face of the aluminum layer 410*b*.

An alumite layer 410*c* and a surface coating layer 410*d* are sequentially formed on the upper face of the aluminum layer 410*b*. By forming the alumite layer 410*c*, corrosion resistance of the upper face of the aluminum layer 410*b* is improved. The surface coating layer 410*d* is formed by predetermined pigments and the like.

Thermistor 411 is mounted on the lower face of the aluminum layer 410*b* with the radiation absorption layer 410*a* interposed therebetween. Thermistor 411 detects temperature of the aluminum layer 410*b* via the radiation absorption layer 410*a*.

Figure 7:
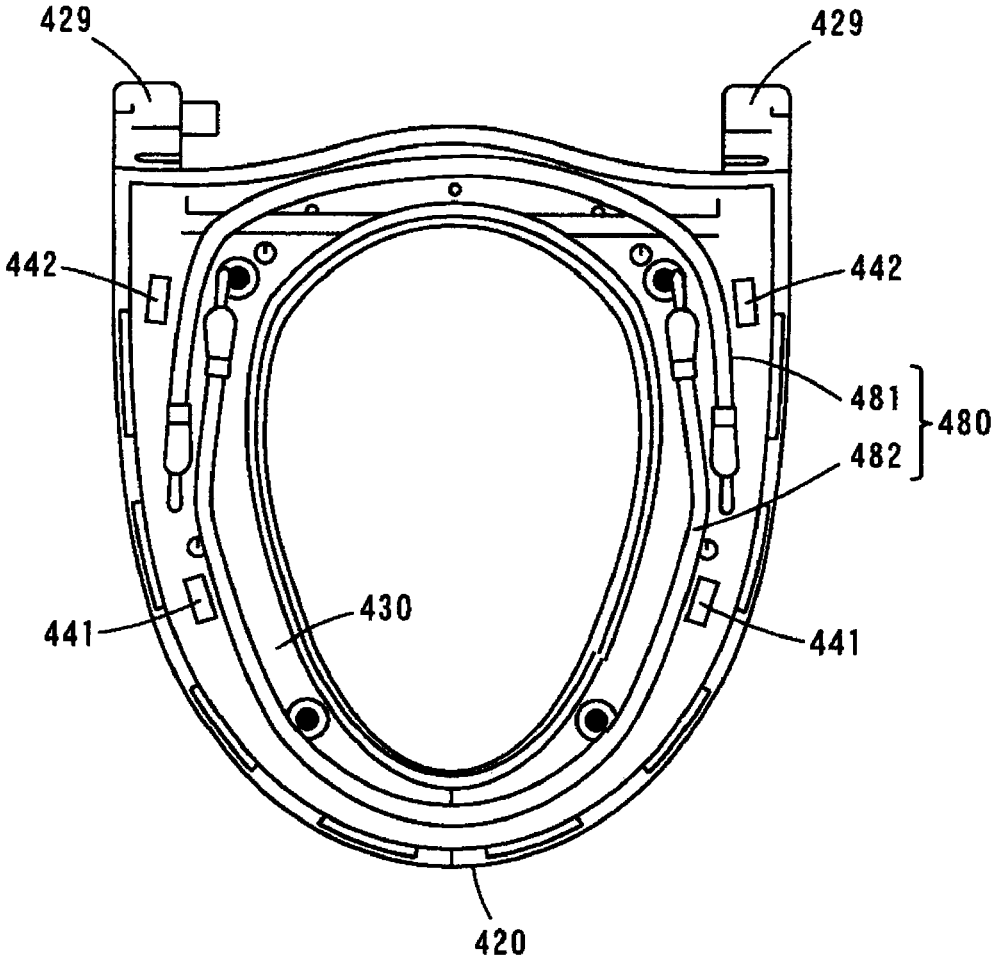
FIG. 7 is a diagram illustrating a detailed structure of the toilet seat section in FIG. 1.

FIG. 7 shows a view of the lower toilet seat casing 420 as viewed from the upper side. As shown in FIGS. 4 and 7, the radiation reflection plate 430 that is formed so as to follow the lower toilet seat casing 420 shape is mounted on the upper face side of the lower toilet seat casing 420. The radiation reflection plate 430 is manufactured by making a surface of aluminum plate to be a mirror.

In addition, the lamp heater 480 is disposed on the upper face of the radiation reflection plate 430. The lamp heater 480 is manufactured by connecting in series the rear lamp heater 481 with the front lamp heater 482 formed in a U shape.

In addition, on the upper face of the radiation reflection plate 430, two thermostats 441 are mounted so as to be adjacent to predetermined places (two places) of the front lamp heater 482, and two thermostats 442 are mounted so as to be adjacent to predetermined places (two places) of the rear lamp heater 481. The all thermostats 441 and 442 are connected to the lamp heater 480 in series.

The upper toilet seat casing 410 in FIG. 5 is conjugated with the lower toilet seat casing 420 in FIG. 7 via seal material, and thus the toilet seat section 400 in FIG. 1 is formed completely. With such a configuration, airtight space is formed in the upper toilet seat casing 410 and the lower toilet seat casing 420. By using the seal material, water permeation into the upper toilet seat casing 410 and the lower toilet seat casing 420 is prevented. In this state, thermistors 411 mounted on the upper toilet seat casing 410 faces the front lamp heater 482.

The rear lamp heater 481 and front lamp heater 482 is a halogen lamp heater formed of a glass tube, a filament, argon gas, and halogen gas.

In the rear lamp heater 481 and the front lamp heater 482, the filament is disposed in the glass tube, and argon gas and halogen gas is sealed therein.

Rated electric powers of the rear lamp heater 481 and the front lamp heater 482 according to the embodiment are 500 W and 700 W, respectively.

(4-b) Drive of Lamp Heater

As described above, the rear lamp heater 481 and the front lamp heater 482 are connected to the heater driving section 230 in FIG. 3. When current is applied to the rear lamp heater 481 and the front lamp heater 482 by the heater driving section 230, infrared rays are radiated from the lamp heaters.

The infrared rays radiated from the rear lamp heater 481 and the front lamp heater 482, that is, radiation energy is directly incident on the lower face side of the upper toilet seat casing 410 or indirectly incident on upper toilet seat casing 410 by passing through the radiation reflection plate 430.

As described above, the black-colored radiation absorption layer 410*a* (FIG. 6) can efficiently absorb the radiation energy, and thus the radiation energy from the rear lamp heater 481 and the front lamp heater 482 is efficiently transmitted to the aluminum layer 410*b* (FIG. 6). Accordingly, the aluminum layer 410*b* generates heat.

As described above, aluminum has high thermal conductivity, and thus the heat generated by the radiation energy is transmitted to the entire body of the upper toilet seat casing 410 in a short time.

(4-c) Function of Thermistors

In the upper toilet seat casing 410, functions of thermistor 411 mounted on an area of the seating section 410T and thermistor 412 mounted on the other area excluding the seating section 410T will be described.

The seating section 410T of the upper toilet seat casing 410 is disposed closer to the lamp heater 480 than the other parts. With such a configuration, heat is transmitted with relatively high responsiveness to the seating section 410T of the upper toilet seat casing 410 at the time of driving the lamp heater 480.

In addition, since the seating section 410T is a part in contact with a human body in the upper toilet seat casing 410, proper temperature management is needed.

Accordingly, thermistor 411 of the seating section 410T is used for temperature adjustment at the time of driving the lamp heater 480.

Meanwhile, thermistor 412 mounted on the other area excluding the seating section 410T is used so as to prevent the upper toilet seat casing 410 from overheat when thermistor 411 is out of order.

(4-d) Function of Thermostats

In the lower toilet seat casing 420, functions of two thermostats 441 mounted adjacent to the front lamp heater 482 and two thermostats 442 mounted adjacent to the rear lamp heater 481 will be described.

The two thermostats 441 of the front lamp heater 482 side are used in order to monitor temperature of the front lamp heater 482. The two thermostats 441 are set so as to stop the current applied to the lamp heater 480 at, for example, 78° C. Accordingly, the two thermostats 441 have a function of a thermal fuse for stopping current at 78° C.

Meanwhile, the two thermostats 442 of the rear lamp heater 481 side are used in order to monitor environmental temperature around the rear lamp heater 481. The two thermostats 442 are set so as to stop the current applied to the lamp heater 480 at, for example, 53° C. Accordingly, the two thermostats 442 serve as a thermal fuse for cutting off current at 53° C.

(5) Heater Control Table and Heater Control Pattern

Three heater control tables corresponding to three kinds of toilet seat set temperature (34° C., 36° C., and 38° C.) are stored in the control section 210 of the toilet seat device 100 according to the embodiment.

Figures 10, 11:
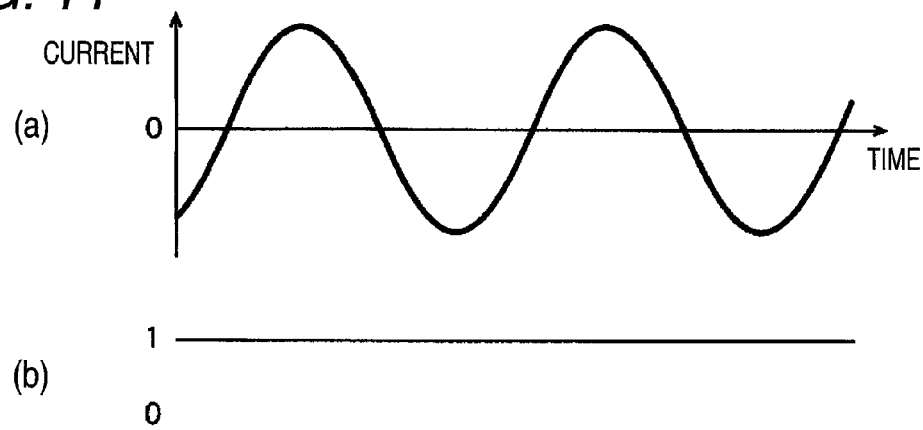
FIG. 10 is a diagram illustrating an example of heater control tables corresponding to predetermined toilet seat set temperatures (34° C., 36° C., and 38° C.).
FIG. 11(*a*) is a waveform diagram illustrating current that flows in a lamp heater during 1200 W drive, and FIG. 11(*b*) is a waveform diagram illustrating a current control signal given to a heater driving section from A duty ratio switching circuit during the 1200 W drive.

FIGS. 8 to 10 are diagrams illustrating examples of heater control tables corresponding to predetermined toilet seat set temperatures (34° C., 36° C., and 38° C.). The heater control tables as shown in FIGS. 8 to 10 have a plurality of heater control patterns corresponding to measured temperature values of thermistor 411 (FIG. 3) at the time of user's entry into a room, respectively.

A time schedule for driving the lamp heater 480 is set in the plurality of heater control patterns, respectively. In addition, a measured temperature value of thermistor 411 at the time of switching the electric power for driving the lamp heater 480 is set in each heater control pattern. Detailed description will be given later.

As described above, when the toilet seat set temperature is determined, the control section 210 selects one heater control table corresponding to the determined toilet seat set temperature.

In addition, when entry sensor 600 in FIG. 3 senses user's entry, the control section 210 selects one heater control table among the heater control tables on the basis of the measured temperature value of thermistor 411. With such a configuration, the lamp heater 480 is controlled to be driven on the basis of the selected heater control pattern.

For example, when the low toilet seat set temperature (34° C.) is set and the measured temperature value at the time of user's entry is 16° C. to 18° C., the control section 210 in FIG. 3 performs 600 W drive to be described later for reducing inrush current for 0.2 seconds, on the basis of the heater control pattern corresponding to 16° C. to 18° C. in the heater control table in FIG. 8.

After that, the control section 210 performs 1200 W drive to be described later for 6 seconds, and continuously performs the 600 W drive to be described later for 2.1 seconds.

In the toilet seat device 100 according to the embodiment as described above, temperature of the toilet seat section 400 is adjusted at, for example, about 18° C. when the heating function is turned on.

In the heater control tables in FIGS. 8 to 10, there is assumed that the heating function is switched from OFF state into ON state. Accordingly, the heater control patterns corresponding to 0° C. to 16° C. are also set in the heater control tables in FIGS. 8 to 10.

That is, when a user turns on the heating function at room temperature 0° C., the control section 210 performs the 600 W drive for 16 seconds, for example, on the basis of the heater control pattern corresponding to 0° C. to 2° C. in the heater control table in FIG. 8.

(6) Drive of Lamp Heater

In the embodiment, a control operation of a drive of the lamp heater 480 is performed by changing the electric power for driving the lamp heater 480 mainly into three kinds.

For example, when temperature of the toilet seat section 400 is increased along a first temperature gradient, the heater driving section 230 in FIG. 3 drives the lamp heater 480 with about electric power of 1200 W (1200 W drive). In addition, when temperature of the toilet seat section 400 is increased along a second temperature gradient slightly lower than the first temperature gradient, the heater driving section 230 drives the lamp heater 480 with about electric power of 600 W (600 W drive). Further, when temperature of the toilet seat section 400 is maintained at a constant level, the heater driving section 230 drives the lamp heater 480 with electric power of about 50 W (low electric power drive). The low electric power drive is defined to drive the lamp heater 480 with low electric power (for example, electric power in the range of 0 W to 50 W) that is sufficiently lower than the 1200 W drive and the 600 W drive.

A duty ratio switching circuit of the control section 210 performs a switching operation among the 1200 W drive, the 600 W drive and the low electric power drive by controlling current applied from the heater driving section 230 to the lamp heater 480.

Alternating current is supplied from a power supply circuit not shown in the drawing to the heater driving section 230. Accordingly, the heater driving section 230 makes the alternating current, which is supplied on the basis of a current control signal received from the duty ratio switching circuit, flow into the lamp heater 480.

Each state where current is applied to the lamp heater 480 at the time of 1200 W drive, 600 W drive, and low electric power drive will be described with the current control signal of the duty ratio switching circuit.

FIG. 11(*a*) is a waveform diagram illustrating current that flows in the lamp heater 480 during the 1200 W drive, and FIG. 11(*b*) is a waveform diagram illustrating the current control signal given to the heater driving section 230 from the duty ratio switching circuit during the 1200 W drive.

As shown in FIG. 11(*b*), the current control signal at the time of the 1200 W drive is logic '1' in any case. The heater driving section 230 makes the alternating current, which is supplied from the power supply circuit when the current control signal is logic '1', flow in the lamp heater 480 (a thick-lined part in FIG. 11(*a*)). Accordingly, the alternating current flows in the lamp heater 480 in the range of entire cycle periods. As a result, the lamp heater 480 is driven by about electric power of 1200 W.

Figure 12:
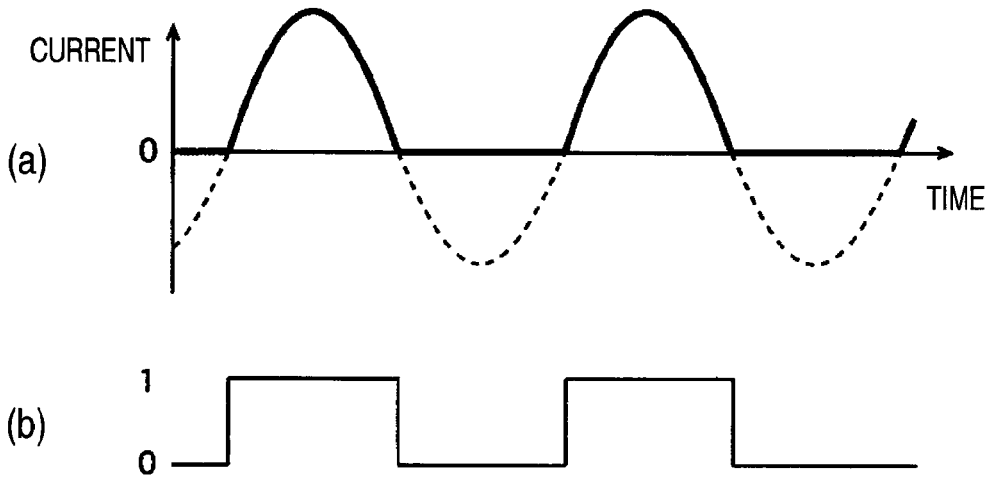
FIG. 12(*a*) is a waveform diagram illustrating current that flows in the lamp heater during 600 W drive, and FIG. 12(*b*) is a waveform diagram illustrating a current control signal given to the heater driving section from the duty ratio switching circuit during the 600 W drive.

FIG. 12(*a*) is a waveform diagram illustrating current that flows in the lamp heater 480 during the 600 W drive, and FIG. 12(*b*) is a waveform diagram illustrating the current control signal given to the heater driving section 230 from the duty ratio switching circuit during the 600 W drive.

As shown in FIG. 12(*b*), the current control signal at the time of the 600 W drive is formed of pulses that has the same cycle as the alternating current supplied to the heater driving section 230. Duty ratio of the pulses is set as 50%.

The heater driving section 230 makes the alternating current, which is supplied from the power supply circuit when the current control signal is logic '1', flow in the lamp heater 480 (a thick-lined part in FIG. 12(*a*)). Accordingly, alternating current flows in the lamp heater 480 for half-cycle periods. As a result, the lamp heater 480 is driven by about electric power of 600 W.

Figure 13:
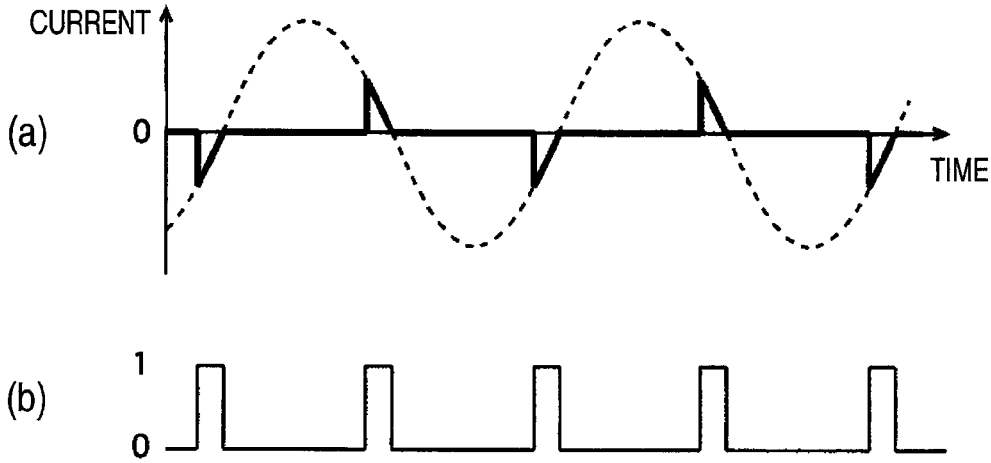
FIG. 13(*a*) is a waveform diagram illustrating current that flows in the lamp heater during a low electric power drive, and FIG. 13(*b*) is a waveform diagram illustrating a current control signal given to the heater driving section from the duty ratio switching circuit during the low electric power drive.

FIG. 13(*a*) is a waveform diagram illustrating the current that flows in the lamp heater 480 during the low electric power drive, and FIG. 13(*b*) is a waveform diagram illustrating the current control signal given to the heater driving section 230 from the duty ratio switching circuit during the low electric power drive.

As shown in FIG. 13(*b*), the current control signal at the time of the 600 W drive is formed of pulses that has the same cycle as the alternating current supplied to the heater driving section 230. Duty ratio of the pulses is set less than 50% (for example, about several %).

The heater driving section 230 makes the alternating current, which is supplied from the power supply circuit when the current control signal is logic '1', flow in the lamp heater 480 (a thick-lined part in FIG. 13(*a*)). In each cycle, alternating current flows in the lamp heater 480 during period corresponding to the pulse width. As a result, the lamp heater 480 is driven by, for example, electric power of about 50 W.

When the temperature of the toilet seat section 400 is lowered by using the other methods or the heating function of the toilet seat device 100 is turned off, the duty ratio switching circuit does not send the current control signal to the heater driving section 230 (the current control signal is set as logic '0'). With such a configuration, the heater driving section 230 does not drive the lamp heater 480.

Generally, when current supplied to electronics has harmonic components, noise occurs. In the embodiment as described above, when the 1200 W drive or the 600 W drive is performed on the lamp heater 480, the current supplied to the lamp heater 480 varies along a sine curve, and thus it is possible to sufficiently reduce occurrence of noise even when current increases.

In addition, when the low electric power drive of the lamp heater 480 is performed, the current supplied to the lamp heater 480 has harmonic components, but the current is extremely small as compared with current of the 1200 W drive and the 600 W drive. Accordingly, it is possible to sufficiently reduce occurrence of noise.

In the embodiment as described above, the lamp heater 480 is driven with the electric powers having 1200 W, 600 W, and about 50 W, but the lamp heater 480 may be driven with electric power having different levels.

For example, when alternating current flows in the lamp heater 480 during half-cycle periods, a timing of the alternating current is set at intervals of a predetermined cycle such as two cycles or three cycles. With such a configuration, the lamp heater 480 can be driven by electric power having different level from 1200 W, 600 W, and, about 50 W while occurrence of noise is sufficiently prevented.

In the following description, duty ratio is defined as a ratio of time (which is a period of logic '1' in the current control signal) in which the alternating current flows in the lamp heater 480 during one cycle of the alternating current.

In the embodiment, the control section 210 supplies current to the lamp heater 480 when the current control signal is logic '1' and stops the current supply to the lamp heater 480 when the current control signal is logic '0'. However, the control section 210 may stop the current supply to the lamp heater 480 when the current control signal is logic '1' and may supply the current to the lamp heater 480 when the current control signal is logic '0'.

(7) Method of Making Heater Control Table (7-a) Inrush Current

In the toilet seat device 100 according to the embodiment, large current flows in the lamp heater 480 when the temperature of the toilet seat section 400 instantly increases. In this case, comparatively large inrush current occurs in the lamp heater 480.

When the large inrush current occurs, a circuit breaker is operated by overcurrent, and voltage drop occurs in the electric power wiring to which the toilet seat device 100 is connected.

Accordingly, when making the heater control table, it is preferred that the plurality of heater control patterns be set so as to sufficiently reduce the inrush current.

In examples of FIGS. 8 to 10, when the 1200 W drive is performed on the lamp heater 480, the heater control pattern is set so as to perform the 600 W drive just before the 1200 W drive. In FIGS. 8 to 10, the 600 W drive before the 1200 W drive is represented by 600 W drive for reducing inrush current.

(7-b) Overshoot

As described above, large current flows in the lamp heater 480 in order to instantly increase the temperature of the toilet seat section 400 by using the lamp heater 480. Accordingly, overshoot occurs in temperature variance of the toilet seat section 400. Hence, it is difficult to stabilize the temperature of the toilet seat section 400 at the toilet seat set temperature in a short time.

In the embodiment, when making the heater control table, the plurality of heater control patterns are set so as to sufficiently reduce the overshoot in the temperature variance of the toilet seat section 400.

In the examples of the heater control table in FIGS. 8 to 10, in order to prevent the toilet seat section 400 from the overshoot in the temperature variance, the drive of the lamp heater 480 is set so as to be controlled by two steps when temperature of the toilet seat section 400 increases.

(7-c) Limit Temperature

In the toilet seat device 100 having a heating function, it is preferred to make a user not to feel that the seating section 410T is cold. Hereinafter, the minimum temperature of the seating section 410T that makes a user not to feel cold is referred to as limit temperature.

Accordingly, when a user enters a toilet room and sits on the seating section 410T, it is preferred that at least the temperature of the seating section 410T should have been higher than the limit temperature.

Therefore, when making the heater control table, the plurality of heater control patterns are set so as to sufficiently decrease the time while surface temperature of the seating section 410T at the time of user's entry is increased to the limit temperature. In addition, the limit temperature was about 29° C. as the result of the experiment performed by the applicant.

In the examples of the heater control tables in FIGS. 8 to 10, since the temperature of the toilet seat section 400 is instantly increased to the limit temperature, the lamp heater 480 is set to perform the 1200 W drive when the measurement temperature at the time of user's entry is less than the limit temperature.

(7-d) Seating Section and Sensory Temperature

Temperature (sensory temperature) that a user feels at the time of sitting on the seating section 410T is different from actual surface temperature of the seating section 410T.

Generally, the sensory temperature felt when a human body comes in contact with a specified object varies in accordance with thermal conductivity of the object, thermal capacity difference between the human body and the object, and the like.

Accordingly, there is a case where difference occurs between the actual surface temperature of the seating section 410T and the sensory temperature felt by a user sitting on the seating section 410T.

In the embodiment, the seating section 410T is made of aluminum that is excellent in thermal conductivity.

With such a configuration, for example, when the temperature of the seating section 410T is lower than body temperature of a user, the body temperature of a user is transmitted to the seating section 410T in a short time. Therefore, the sensory temperature of a user becomes lower than the actual temperature of the seating section 410T.

Accordingly, when making the heater control table, the plurality of heater control patterns are set so that the sensory temperature at the time of user's seating is as close as possible to the toilet seat set temperature.

(7-e) Relationship Between Temperature of Lamp Heater and Surface Temperature of Seating Section When temperature of the toilet seat section 400 increases, there is a large temperature difference between the surface temperature (temperature of a glass tube) of the lamp heater 480 and the actual surface temperature of the seating section 410T.

Accordingly, in order to increase the surface temperature of the seating section 410T to the toilet seat set temperature and stably maintain the temperature, it takes a predetermined time from the drive start time of the lamp heater 480.

Therefore, the applicant performed the following test (a toilet seat temperature rise test) with respect to the time from when the drive of the lamp heater 480 starts until when the surface temperature of the seating section 410T is stabilized at the toilet seat set temperature.

When room temperature of the toilet is about 25° C., the toilet seat set temperature was set by about 40° C. In this state, the lamp heater 480 was driven. Then, the time until when the surface temperature of the seating section 410T is stabilized at about 40° C. was measured. As a result, the relationship shown in FIG. 14 was obtained.

Figure 14:
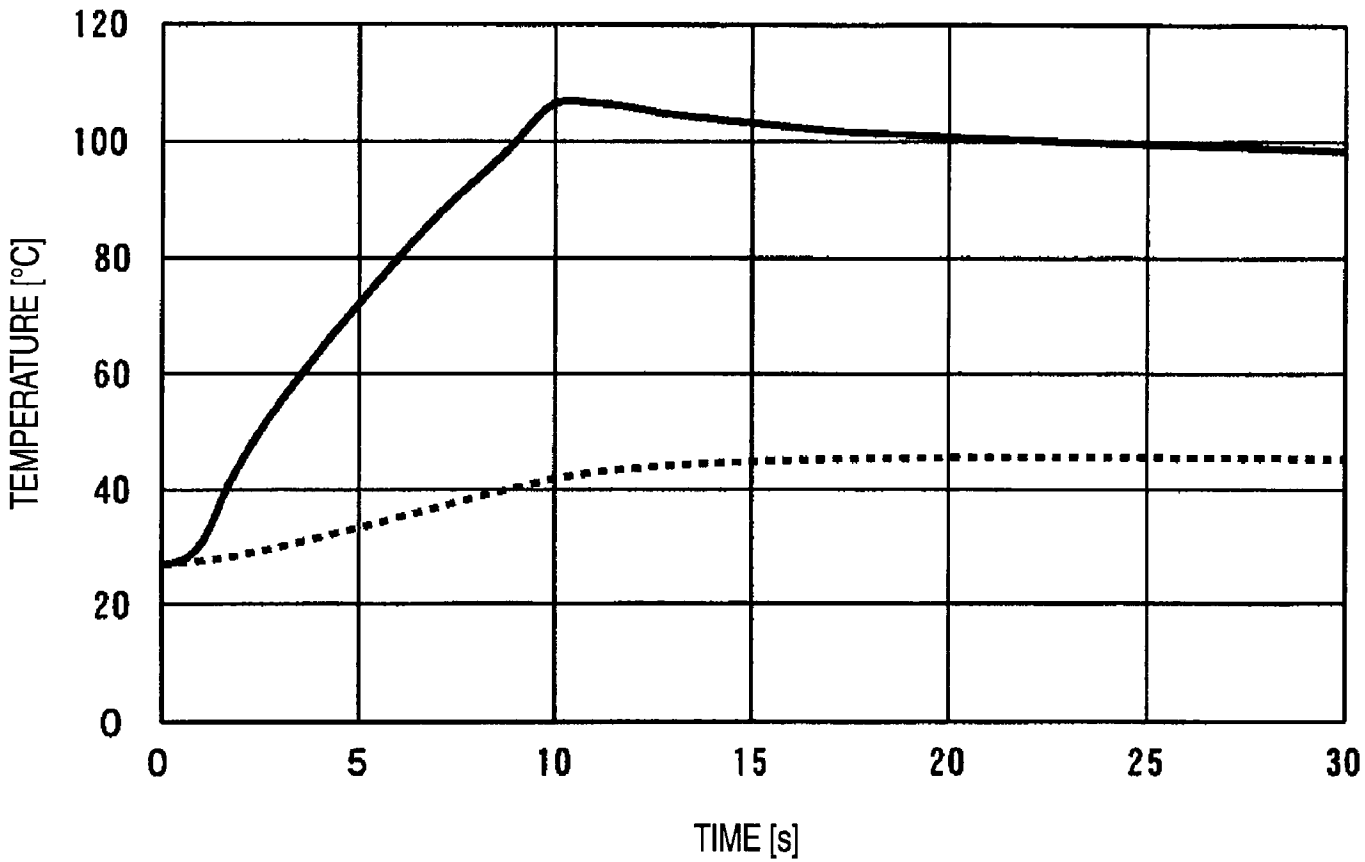
FIG. 14 is a diagram illustrating a relationship between surface temperature of a seating section and surface temperature of the lamp heater at the time of a toilet seat temperature rise test.

FIG. 14 is a diagram illustrating the relationship between the surface temperature of the seating section 410T and the surface temperature of the lamp heater 480 at the time of the toilet seat temperature rise test. In FIG. 14, a vertical axis represents temperature, and a horizontal axis represents time. In addition, a thick solid line represents the surface temperature of the lamp heater 480 and a thick dotted line represents the surface temperature of the seating section 410T.

As shown in FIG. 14, the lamp heater 480 is driven, and thus the surface temperature of the lamp heater 480 reaches 100° C. in about 10 seconds. Then, the surface temperature of the lamp heater 480 is constantly maintained at about 100° C.

Meanwhile, as the surface temperature of the lamp heater 480 varies, the surface temperature of the seating section 410T slightly increases and reaches about 40° C. in about 10 seconds. Then, the surface temperature of the seating section 410T is constantly maintained at about 45° C.

In this manner, for example, the difference between the surface temperature of the seating section 410T and the toilet seat set temperature increases as time passes, and the difference is maintained at a substantially constant level after about 10 seconds.

That is, when the temperature is controlled in a shorter time than 10 seconds, it is difficult to control the current that flows in the lamp heater 480 in consideration of difference between the surface temperature of the lamp heater 480 and the surface temperature of the seating section 410T.

Accordingly, when making the heater control tables, the plurality of heater control patterns are set in consideration of the electric power used in the drive of the lamp heater 480 and necessary time to stabilize temperature of the seating section 410T at the toilet seat set temperature due to the electric power.

(7-f) Relationship Between Temperature Value Measured by Thermistor and Surface Temperature of Seating Section When temperature of the toilet seat section 400 increases, temperature difference occurs between temperature value measured by thermistor 411 and actual surface temperature of the seating section 410T in FIG. 3.

Therefore, the applicant performed the following test (a test for estimating the measured temperature value) with respect to relationship between the temperature value measured by thermistor 411 and the actual surface temperature of the seating section 410T, when temperature of the toilet seat section 400 increases.

When room temperature of the toilet is 21° C., the toilet seat set temperature was set by about 38° C. In this state, the lamp heater 480 was driven during a predetermined time. Then, the time until when the measured temperature value and the surface temperature of the seating section 410T had been stabilized at about 38° C. was measured. As a result, the relationship shown in FIG. 15 was obtained.

Figure 15:
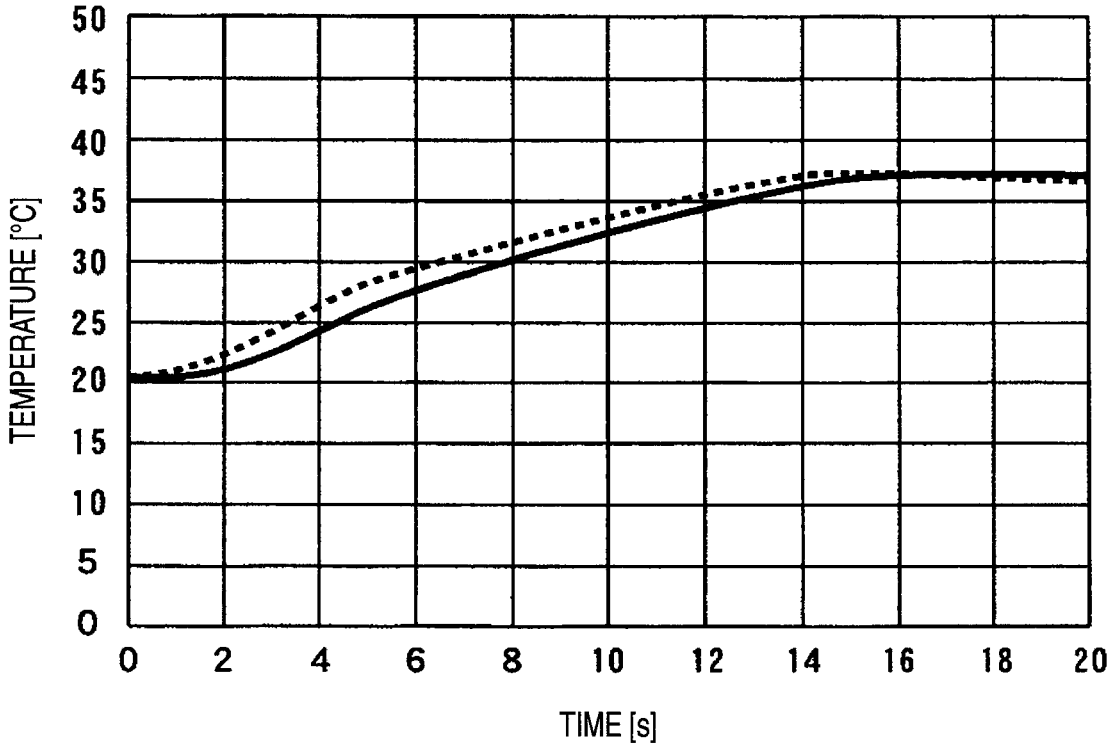
FIG. 15 is a diagram illustrating a relationship between the surface temperature of the seating section and a temperature value measured by a thermistor at the time of a test for estimating the measured temperature value.

FIG. 15 is a diagram illustrating the relationship between the surface temperature of the seating section 410T and the temperature value measured by thermistor 411 at the time of the test for estimating the measured temperature value. In FIG. 15, a vertical axis represents temperature, and a horizontal axis represents time. In addition, a thick solid line represents the temperature value measured by thermistor 411 and a thick dotted line represents the surface temperature of the seating section 410T.

As shown in FIG. 15, when the lamp heater 480 is driven and temperature of the toilet seat section 400 increases, the temperature difference occurs between the measured temperature value and the surface temperature of the seating section 410T.

In an example in FIG. 15, after about 4 seconds from the drive start time of the lamp heater 480, there is a temperature difference of about 2.5° C. between the measured temperature value and the surface temperature of the seating section 410T.

In addition, not shown in the drawings, but when the test for estimating the measured temperature value was performed by using the other state, there was a temperature difference of about 6° C. as the maximum value between the measured temperature value and the surface temperature of the seating section 410T.

That is, when temperature of the toilet seat section 400 increases, it is difficult to accurately control the drive of the lamp heater 480 on the basis of the temperature value measured by thermistor 411.

Accordingly, when making the heater control tables, the plurality of heater control patterns are set in consideration of the electric power used in the drive of the lamp heater 480 and necessary time to stabilize temperature of the seating section 410T at the toilet seat set temperature due to the electric power.

In addition, the heater control pattern may have the measured temperature value at the time of switching electric power for driving the lamp heater 480. In this case, by performing a pre-test or a simulation, the relationship between the measured temperature value and the surface temperature of the seating section 410T is examined. Then, the measured temperature value at the time of switching electric power is set.

In this manner, when the heater control pattern has information relating to the drive time of the lamp heater 480 and information relating to the measured temperature value, it is possible to more accurately control the drive the lamp heater 480 on the basis of the information.

In the examples in FIGS. 8 to 10, the measured temperature value (conversion temperature) at the time of switching from the 1200 W drive to the 600 W drive is set in addition to the time schedule relating to the drive of the lamp heater 480. The conversion temperature corresponds to the limit temperature on the surface of the seating section 410T.

In this case, the control section 210 performs the 1200 W drive on the lamp heater 480 in accordance with the time schedule when the measured temperature value is in the range of 16° C. to 28° C. at the time of user's entry, and the control section 210 judges whether the measured temperature value reaches the conversion temperature or not.

Accordingly, when the measured temperature value reaches the conversion temperature, the operation of switching from 1200 W drive to the 600 W drive is performed without regard to the time schedule.

In addition, in the examples of the heater control tables in FIGS. 8 to 10, the measured temperature value (target temperature) at the time of switching from the 600 W drive to the low electric power drive is set. The target temperature corresponds to the surface temperature of the seating section 410T in a state of stopping the temperature rise and waiting user's seating.

In this case, the control section 210 performs the 600 W drive on the lamp heater 480 in accordance with the time schedule, and the control section 210 judges whether the measured temperature value reaches the target temperature or not.

Accordingly, when the measured temperature value reaches the target temperature, the operation of switching from 600 W drive to the low electric power drive is performed without regard to the time schedule. Therefore, the surface temperature of the seating section 410T is maintained at a constant level.

(7-g) Prevention of Low Temperature Burn at the Time of Seating

When a human body keeps in contact with a heating source having slightly higher temperature than body temperature for a long time, there is a case where the contact portion of the human body suffers a low temperature burn. In the embodiment, when the toilet seat set temperature is higher than user's body temperature and a user keeps sitting on the toilet seat for a long time, there is a case where the user suffers a low temperature burn.

Accordingly, when making the heater control tables, it is preferred that the plurality of heater control patterns are set so as to gradually decrease the temperature of the seating section 410T as time passes after user's seating.

In the heater control patterns of the heater control tables in FIGS. 8 to 10, time schedule after user seating is omitted. However, it is practically preferred that time schedule of the electric power for driving the lamp heater 480 is set so as to gradually decrease the surface temperature of the seating section 410T after user's seating.

(8) Exemplary Drive of Lamp Heater Based on Heater Control Table

Figure 16:
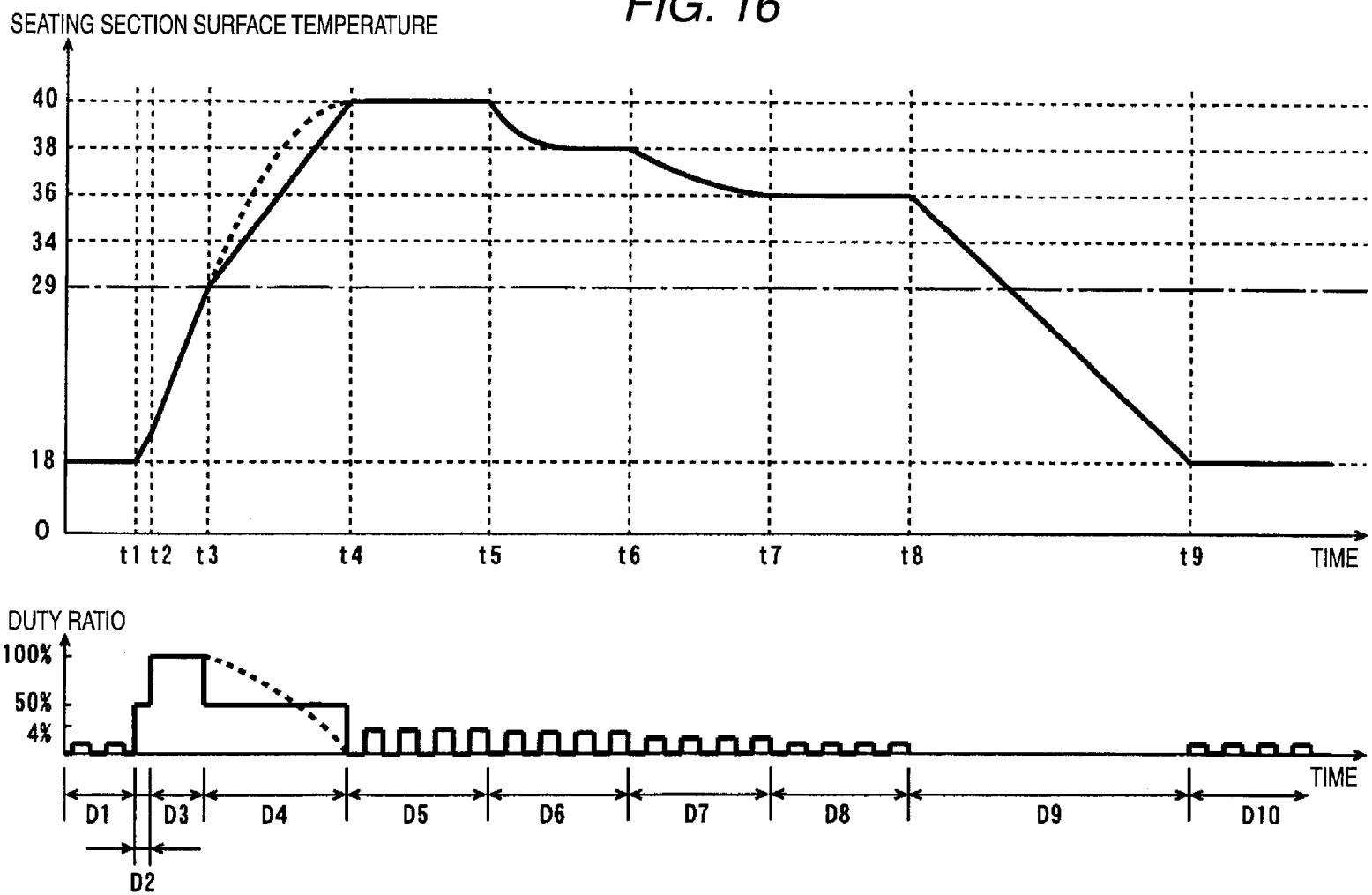
FIG. 16 is a diagram illustrating an exemplary drive of the lamp heater based on the heater control table in FIG. 10 and variance of the surface temperature in the seating section (FIG. 4).
Figure 17:
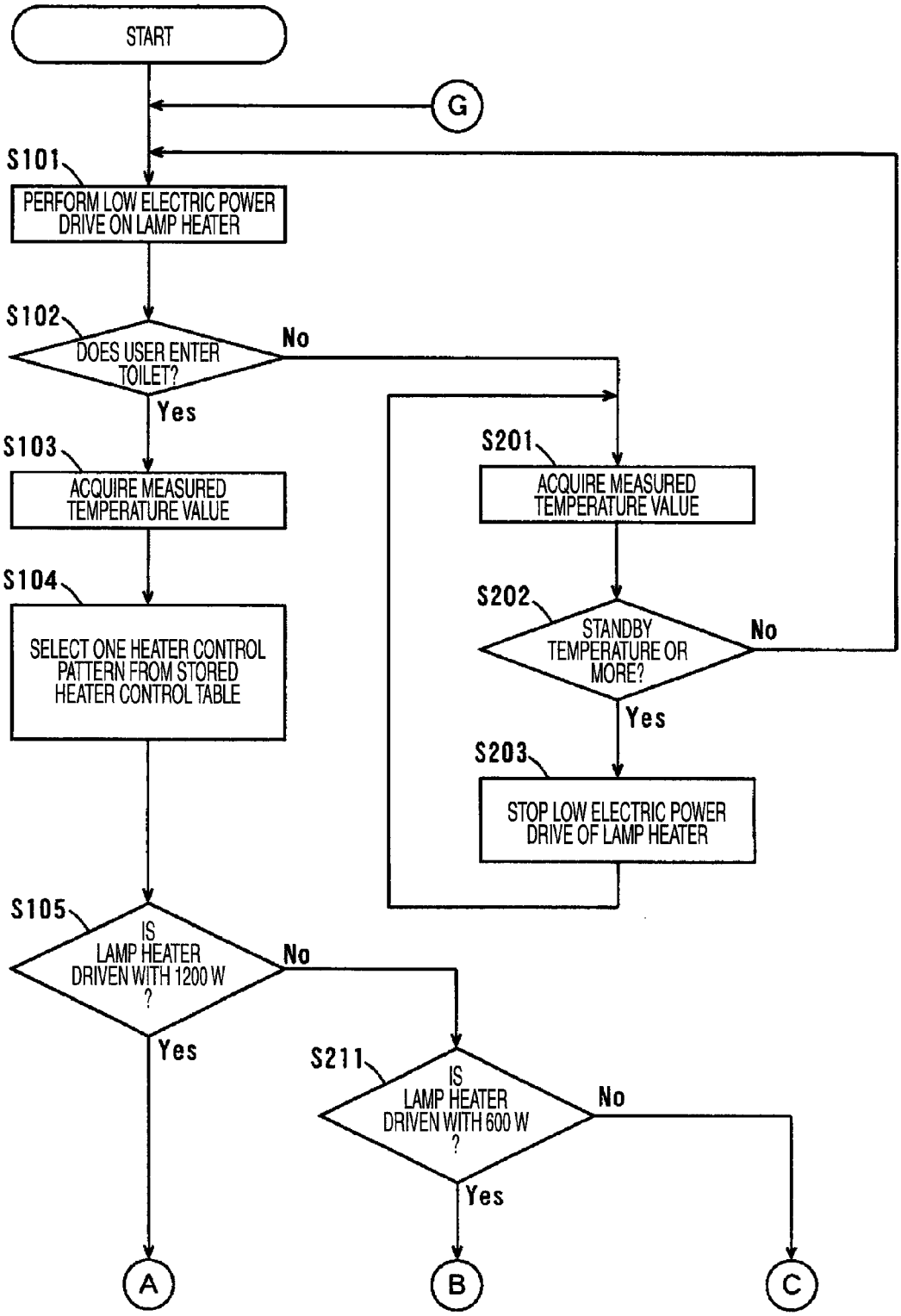
FIG. 17 is a flowchart illustrating an operation of a control section in FIG. 3.
Figure 18:
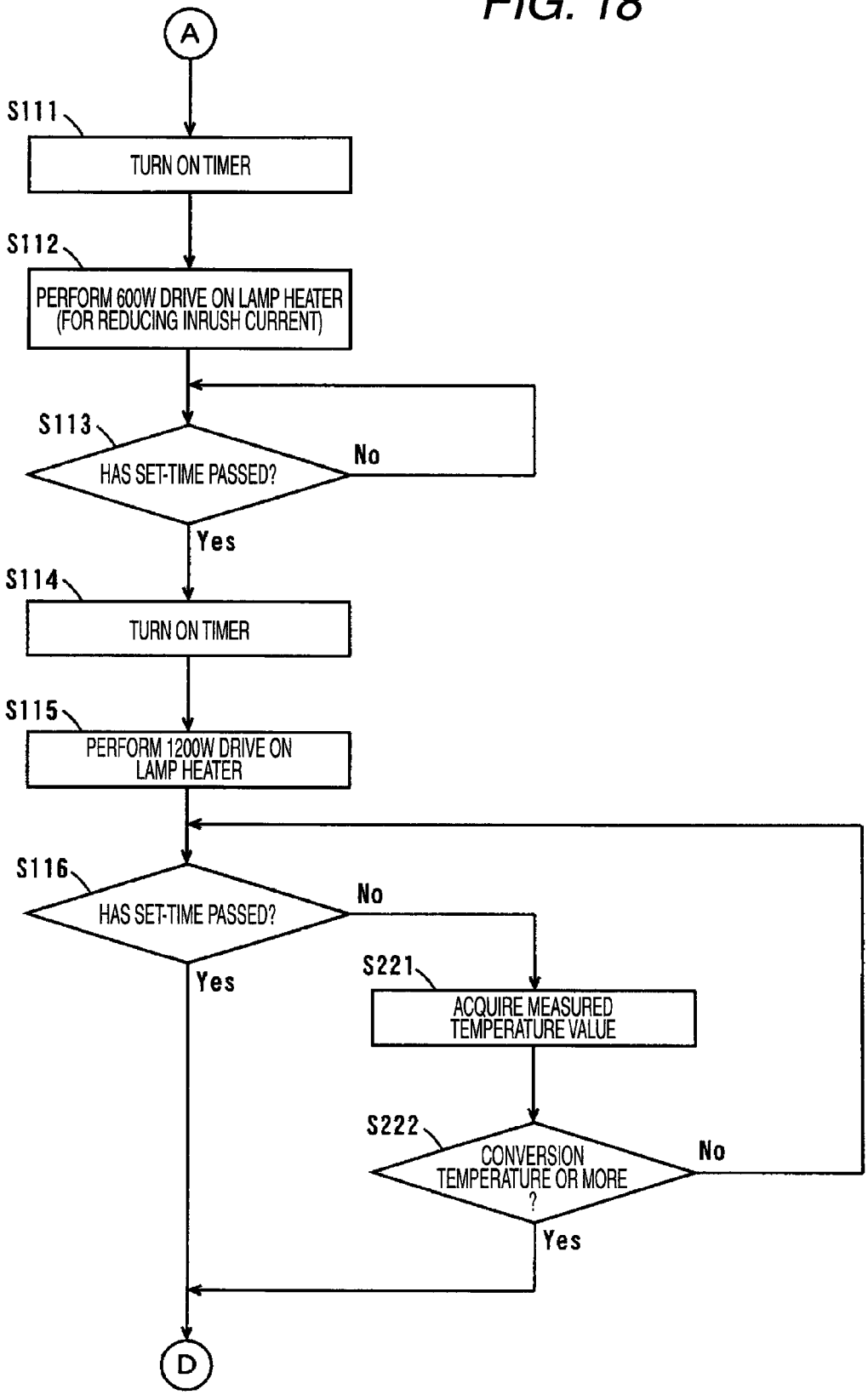
FIG. 18 is a flowchart illustrating an operation of the control section in FIG. 3
Figure 19:
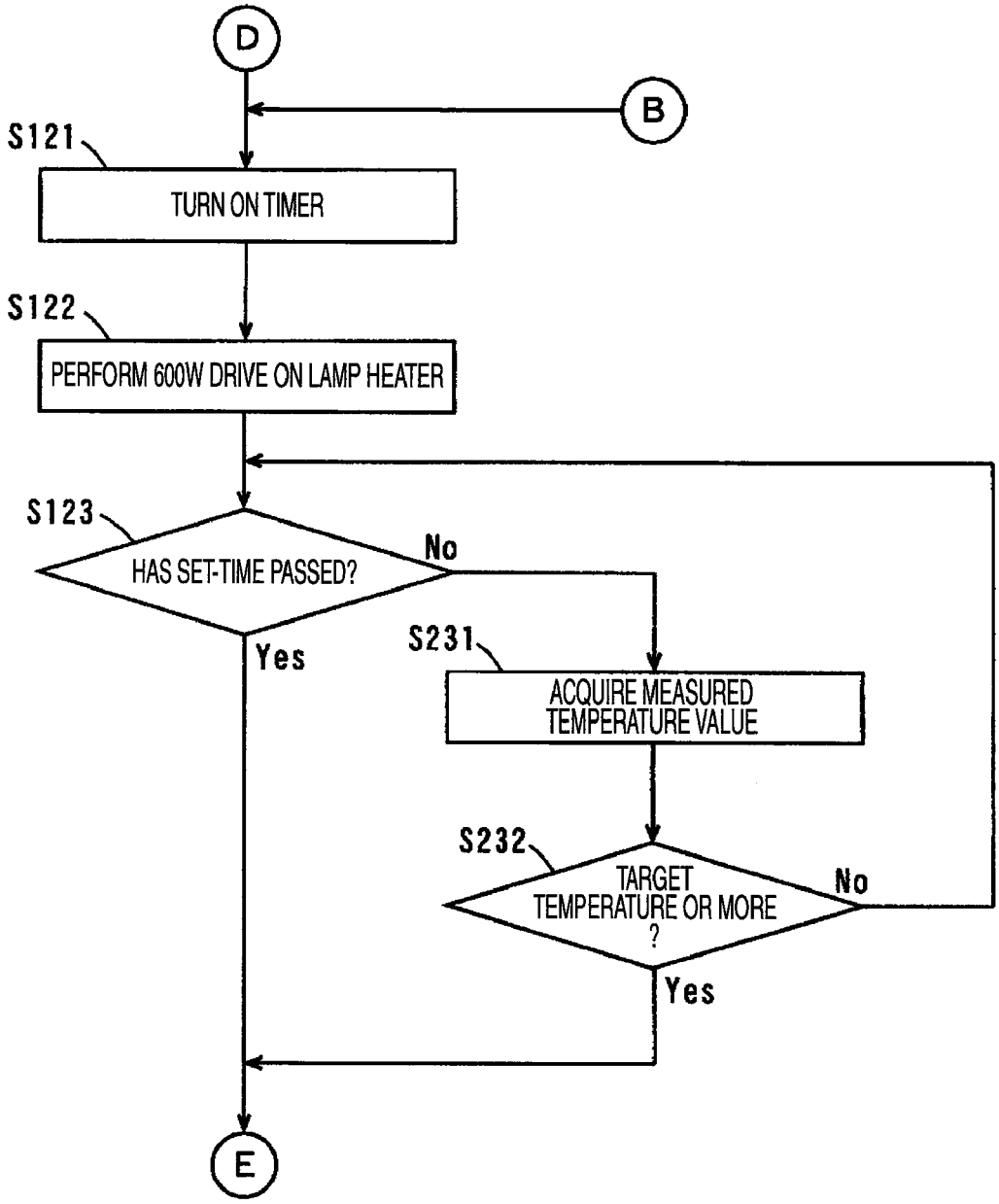
FIG. 19 is a flowchart illustrating an operation of the control section in FIG. 3
Figure 20:
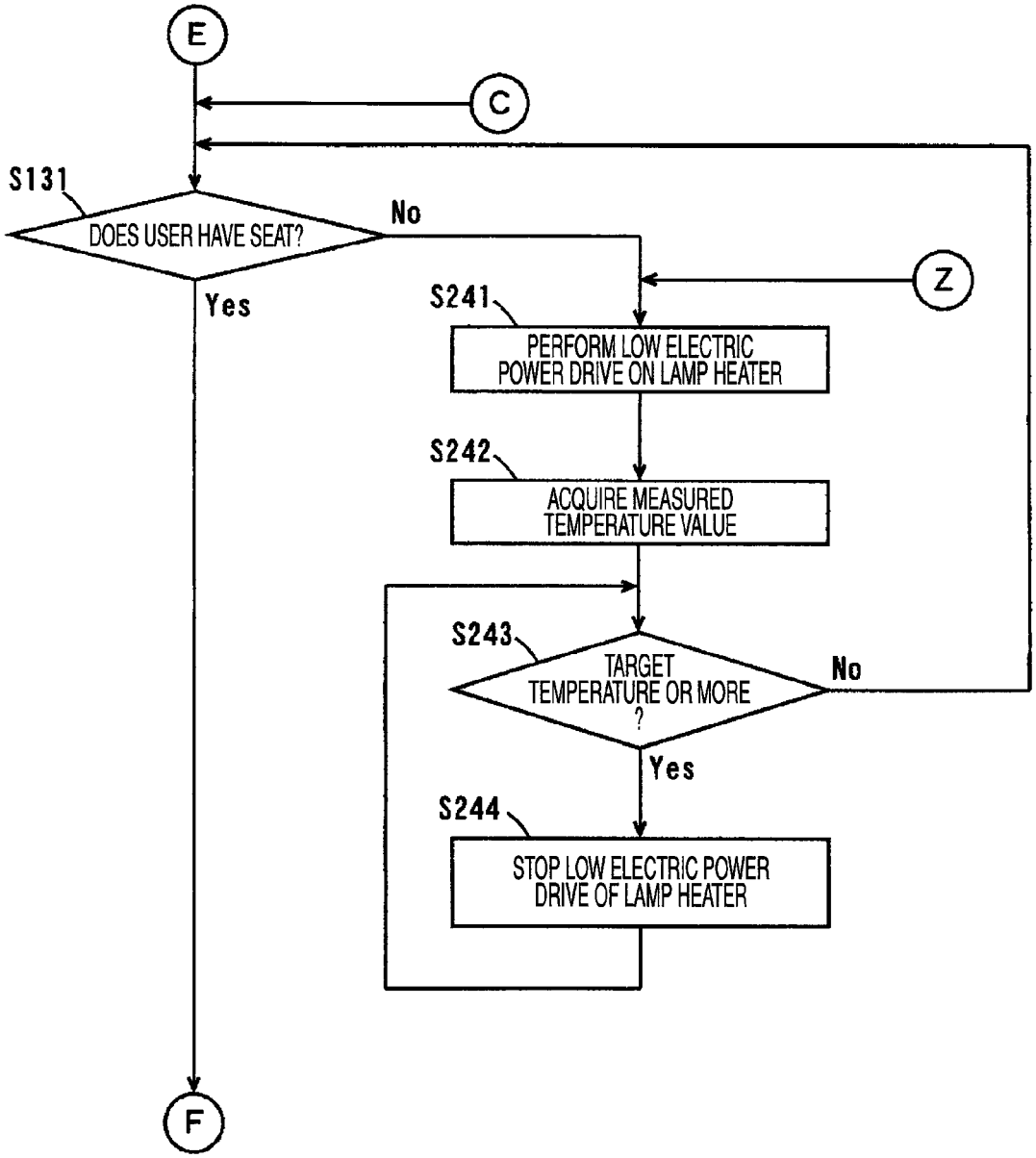
FIG. 20 is a flowchart illustrating an operation of the control section in FIG. 3
Figure 21:
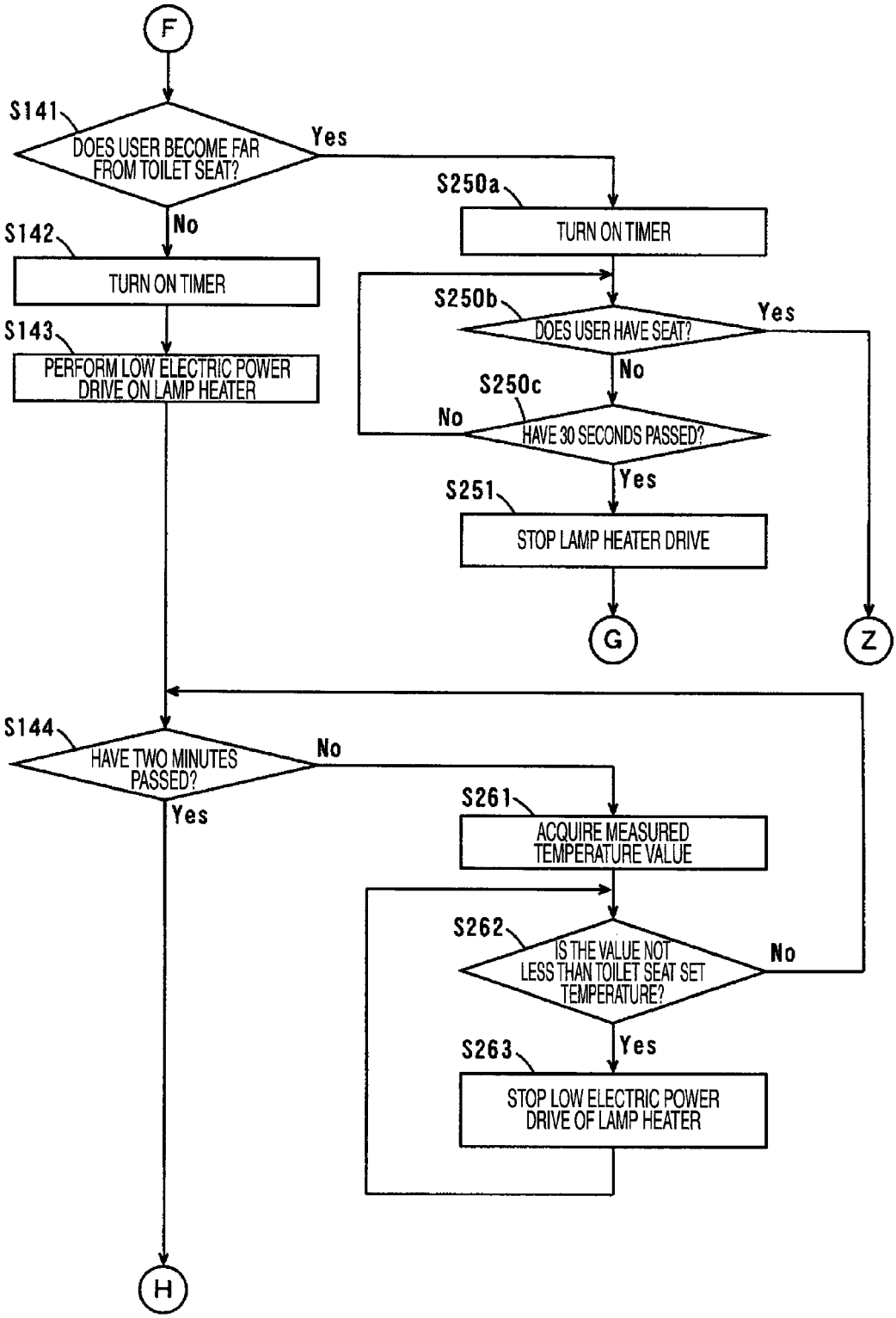
FIG. 21 is a flowchart illustrating an operation of the control section in FIG. 3
Figure 22:
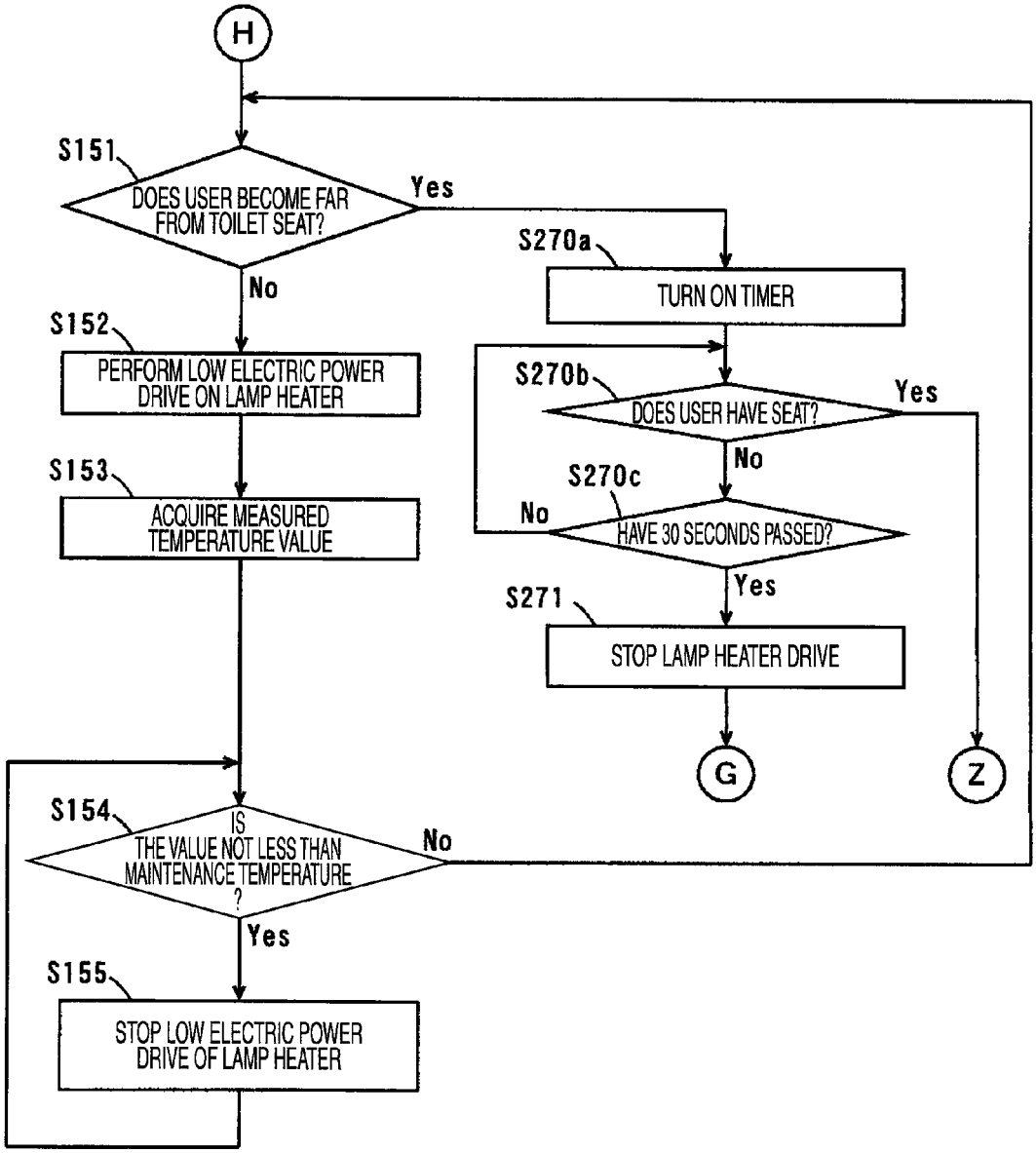
FIG. 22 is a flowchart illustrating an operation of the control section in FIG. 3

FIG. 16 is a diagram illustrating an exemplary drive of the lamp heater 480 based on the heater control table in FIG. 10 and variance of the surface temperature in the seating section 410T (FIG. 4).

FIG. 16 shows a graph illustrating relationship between time and the surface temperature of the seating section 410T and a graph illustrating relationship between time and duty ratio at the time of driving the lamp heater 480. Horizontal axes of the two graphs are a common time axis.

In the example, there is assumed that a user previously turns on the heating function and sets high toilet seat set temperature (38° C.).

As described above, when room temperature is lower than the standby temperature of 18° C. like winter season, the control section 210 (FIG. 3) adjusts the temperature of the toilet seat section 400 to 18° C. In this manner, during the standby period D1 until the entry sensor 600 senses user's entry, the control section 210 performs the low electric power drive on the lamp heater 480 so as to maintain the surface temperature of the seating section 410T at 18° C.

When the entry sensor 600 senses user's entry at time t1, the control section 210 performs the 600 W drive on the lamp heater 480 on the basis of the heater control table in FIG. 10 during an inrush current reduction period D2. In addition, the 600 W drive is performed in order to sufficiently reduce the inrush current. In this case, the surface temperature of the seating section 410T increases along slightly gentle second temperature gradient.

Then, the control section 210 starts the 1200 W drive of the lamp heater 480 at time t2 after the elapse of inrush current reduction period D2 and continuously performs the 1200 W drive on the lamp heater 480 during a first temperature rise period D3. In this case, the surface temperature of the seating section 410T increases along the above-mentioned first temperature gradient.

Here, the surface temperature of the seating section 410T rapidly increases. The 1200 W drive is performed on the lamp heater 480 until the surface temperature of the seating section 410T reaches the limit temperature. In the graph illustrating the surface temperature of the seating section 410T in FIG. 16, the limit temperature that is about 29° C. is represented by a chain line. While the 1200 W drive is performed on the lamp heater 480, the temperature value measured at the time when the surface temperature of the seating section 410T reaches the limit temperature is defined as a conversion temperature in FIG. 10.

Time t3 when the surface temperature of the seating section 410T reaches the limit temperature is defined as a shortest time selected between the time of 1200 W drive determined by the heater control tables and the time when the measured temperature value reaches the conversion temperature determined by the heater control tables.

In this manner, the surface temperature of the seating section 410T is rapidly increased to the limit temperature by the 1200 W drive, in the first temperature rise period D3. With such a configuration, a user can comfortably sit on the toilet seat section 400 without cold feeling of the seating section 410T, even when the above-mentioned notice LED 280 (FIG. 1) is not turned on.

As described above, when the surface temperature of the seating section 410T rapidly increases, overshoot occurs in temperature variance. However, in the embodiment, the 1200 W drive of the lamp heater 480 is switched into the 600 W drive thereof when the surface temperature of the seating section 410T reaches the limit temperature. Accordingly, even when overshoot occurs in surface temperature variance of the seating section 410T, the surface temperature does not exceed the toilet seat set temperature. As a result, a user does not feel hot temperature of the seating section 410T when a user sits thereon.

Subsequently, the control section 210 starts the 600 W drive of the lamp heater 480 at the time t3 after the elapse of first temperature rise period D3 and continuously performs the 600 W drive on the lamp heater 480 during a second temperature rise period D4. In this case, the surface temperature of the seating section 410T increases along the above-mentioned second temperature gradient.

The 600 W drive is performed on the lamp heater 480 until the surface temperature of the seating section 410T reaches slightly higher temperature (40° C.) than the toilet seat set temperature. While the 600 W drive is performed on the lamp heater 480, the temperature value measured at the time when the surface temperature of the seating section 410T reaches the temperature slightly higher than the toilet seat set temperature is defined as a target temperature in FIG. 10.

Time t4 when the surface temperature of the seating section 410T reaches the temperature slightly higher than the toilet seat set temperature is defined as a shortest time selected between the time of 600 W drive determined by the heater control tables and the time when the measured temperature value reaches the target temperature determined by the heater control tables.

The second temperature gradient is lower than the first temperature gradient. Accordingly, occurrence of larger overshoot is prevented in the surface temperature variance of the seating section 410T.

The control section 210 starts the low electric power drive of the lamp heater 480 at the time t4 after the elapse of second temperature rise period D4 and continuously performs the low electric power drive on the lamp heater 480 during a first maintenance period D5. As a result, the surface temperature of the seating section 410T is constantly maintained at slightly higher temperature than the toilet seat set temperature.

In the example, the surface temperature of the seating section 410T increases to the slightly higher temperature than the toilet seat set temperature that is set by a user, and the temperature is maintained until the time of user's seating. Accordingly, the user can feel the substantially same sensory temperature as the toilet seat set temperature that is previously set by the user himself at the time of seating.

When the seat sensor 290 senses user's seating on the toilet seat section 400 at time t5, the control section 210 decreases the duty ratio of the low electric power drive, and the control section 210 continuously performs the low electric power drive on the lamp heater 480 so that the surface temperature of the seating section 410T decreases to the toilet seat set temperature during the first seating period D6. In the example, the first seating period D6 is set as about two minutes.

The control section 210 further decreases the duty ratio of the low electric power drive at the time t6 after the elapse of first seating period D6, and the control section 210 continuously performs the low electric power drive on the lamp heater 480 so that the surface temperature of the seating section 410T decreases to slightly lower temperature (36° C.) than the toilet seat set temperature during a second seating period D7. In the example, the second seating period D7 is set as about two minutes.

The control section 210 more further decreases the duty ratio of the low electric power drive at the time t7 after the elapse of second seating period D7, and the control section 210 continuously performs the low electric power drive on the lamp heater 480 so that the surface temperature of the seating section 410T is constantly maintained at the slightly lower temperature (36° C.) than the toilet seat set temperature during a second maintenance period D8. In the following description, the surface temperature of the seating section 410T constantly maintained during the second maintenance period D8, that is, the temperature slightly lower than the toilet seat set temperature is referred to as a maintenance temperature.

In the example, after a user sits on the toilet seat section 400, the control section 210 gradually decreases the surface temperature of the seating section 410T. As a result, the user is prevented from suffering the low temperature burn.

When the seat sensor 290 senses user's leaving from the toilet seat section 400 at time t8, the control section 210 stops the drive of the lamp heater 480 during a stop period D9. Therefore, the surface temperature of the seating section 410T decreases.

The control section 210 restarts the low electric power drive of the lamp heater 480 at time t9 when the surface temperature of the seating section 410T reaches 18° C., and maintains the low electric power drive of the lamp heater 480 during a standby period D10 so as to constantly maintain the surface temperature of the seating section 410T at 18° C.

In the second temperature rise period D4, the control section 210 performs the 600 W drive on the lamp heater 480, but the control section 210 may gradually decrease the electric power for driving the lamp heater 480 along a parabola (see the thick dotted line part in the graph illustrating duty ratio).

In this case, as shown in the thick dotted line part in the graph illustrating the surface temperature of the seating section 410T, the temperature gradient gradually becomes lower as the surface temperature of the seating section 410T becomes closer to slightly higher temperature than the toilet seat set temperature.

When the temperature gradient gradually becomes gentle as described above, it is possible to sufficiently reduce overshoot caused by temperature variance of the seating section 410T.

In the example, the surface temperature of the seating section 410T is gradually decreased by adjusting the electric power for driving the lamp heater 480 after user's seating on the toilet seat section 400, but the drive of the lamp heater 480 may be stopped at the time of user's seating on the toilet seat section 400. In this case, the user is prevented from suffering the low temperature burn.

In addition, the surface temperature of the seating section 410T is increased to the slightly higher temperature than the toilet seat set temperature, but the surface temperature of the seating section 410T may be increased to the toilet seat set temperature.

(9) Operation of Control Section

FIGS. 17 to 22 are flowcharts illustrating an operation of the control section 210 in FIG. 3. Hereinafter, the operation of the control section 210 will be described with reference to the drawings.

First, the control section 210 performs the low electric power drive on the lamp heater 480 so that the surface temperature of the seating section 410T reaches 18° C. (step S101). Then, the control section 210 judges whether a user enters the toilet room or not by using the entry sensor 600 (step S102).

When the user does not enter the toilet room, the control section 210 acquires the measured temperature value (step S201), and judges whether the measured temperature value is not less than the standby temperature or not (step S202).

When the measured temperature value is not less than the standby temperature, the control section 210 stops the low electric power drive of the lamp heater 480 (step S203), and repeats the operations in the steps S201 to S203. In addition, when the measured temperature value is less than the standby temperature, the control section 210 performs the step S101 again.

The operations (FIG. 17) of the steps S101, S102, and S201 to S203 correspond to the operations of the control section 210 during the standby periods D1 and D10 mentioned above.

In the step S102, when the user enters the toilet room, the control section 210 acquires the measured temperature value (step S103), and selects one heater control pattern from the heater control tables stored in the memory section on the basis of the measured temperature value (step S104).

Then, the control section 210 judges whether information relating to the 1200 W drive of the lamp heater 480 exists in the selected heater control pattern or not (step S105). In addition, when the information relating to the 1200 W drive of the lamp heater 480 does not exist, the control section 210 judges whether information relating to the 600 W drive of the lamp heater 480 exists or not (step S211).

In the step S105, when the information relating to the 1200 W drive of the lamp heater 480 exists, the control section 210 turns on a timer in a timer section included in the control section 210 (step S111), and performs the 600 W drive on the lamp heater 480 in order to reduce inrush current (step S112). Here, the control section 210 judges whether the time set on the basis of the selected heater control table elapses or not (step S113).

The operations (FIG. 18) of the steps S111 to S113 correspond to the operations of the control section 210 during the inrush current reduction period D2 mentioned above.

In the step S211, the control section 210 performs an operation of a step S121 to be described later when the information relating to the 600 W drive of the lamp heater 480 exists, and performs an operation of a step S131 to be described later when the information relating to the 600 W drive of the lamp heater 480 does not exist.

In the step S113, when the set time elapses, the control section 210 resets the timer and turns on the timer again (step S114), and the control section performs the 1200 W drive on the lamp heater 480 (step S115). Here, the control section 210 judges whether the time set on the basis of the selected heater control table elapses or not (step S116).

When the set time does not elapse, the control section 210 acquires the measured temperature value (step S221), and judges whether the measured temperature value is not less than the conversion temperature or not (step S222).

When the measured temperature value is less than the conversion temperature, the control section 210 repeats the operation of the step S116.

The operations (FIG. 18) of the steps S114 to S116, S221, and S222 correspond to the operations of the control section 210 during the first temperature rise period D3 mentioned above.

When the set time elapses in the step S116 or the measured temperature value is not less than the conversion temperature in the step S222, the control section 210 resets the timer and turns on the timer again (step S121), and the control section performs the 600 W drive on the lamp heater 480 (step S122). Here, the control section 210 judges whether the time set on the basis of the selected heater control table elapses or not (step S123).

When the set time does not elapse, the control section 210 acquires the measured temperature value (step S231), and judges whether the measured temperature value is not less than the target temperature or not (step S232).

When the measured temperature value is less than the target temperature, the control section 210 repeats the operation of the step S123.

The operations (FIG. 19) of the steps S121 to S123, S231, and S232 correspond to the operations of the control section 210 during the second temperature rise period D4 mentioned above.

When the set time elapses in the step S123 or the measured temperature value is not less than the target temperature in the step S232, the control section 210 resets the timer, and judges whether a user sits on the toilet seat section 400 by using the seat sensor 290 (step S131).

When the user does not sit, the control section 210 performs the low electric power drive on the lamp heater 480 (step S241). Then, the control section 210 acquires the measured temperature value (step S242), and judges whether the measured temperature value is not less than the target temperature or not (step S243).

When the measured temperature value is not less than the target temperature, the control section 210 stops the low electric power drive of the lamp heater 480 (step S244), and repeats the operation of the step S243. In addition, the control section 210 repeats the operation of the step S131 when the measured temperature value is less than the target temperature.

The operations (FIG. 20) of the steps S131, and S241 to S244 correspond to the operations of the control section 210 during the first maintenance period D5 mentioned above.

When the user sits in the step S131, the control section 210 judges whether the user leaves the toilet seat section 400 or not by using the seat sensor 290 (step S141).

Then, when the user leaves toilet seat section 400, the control section 210 turns on the timer (step S250*a*), and judges again whether the user sits on the toilet seat section 400 by using the seat sensor 290 (step S250*b*).

When the user does not sit, the control section 210 judges whether 30 seconds elapse or not (step S250*c*). When 30 seconds do not elapse, the control section 210 repeats the operation of the step S250*b*. Meanwhile, when 30 seconds elapse, the control section 210 stops the drive of the lamp heater 480 (step S251), performs the operation of the step S101.

When the user sits on the toilet seat section 400 in the step S250*b*, the control section 210 performs the operation of the step S241.

In this manner, the control section 210 performs the operations of the steps S250*a* to S250*c*, and thus a user can sits on the toilet seat section 400 again without a sense of incongruity even when the user instantly stands up from the toilet seat section 400.

When the other user immediately sits on the seat after a first user leaves the toilet seat section 400, the other user can sit on the toilet seat section 400 of which temperature is increased.

Meanwhile, when a user does not leave the toilet seat section 400 in the step S141, the control section 210 turns on the timer again (the step S142), and performs the low electric power drive on the lamp heater 480 (step S143). Here, the control section 210 judges whether two minutes elapse or not by using the timer (step S144).

When the two minutes do not elapse, the control section 210 acquires the measured temperature value (step S261), and judges whether the measured temperature value is not less than the toilet seat set temperature or not (step S262).

When the measured temperature value is not less than the toilet seat set temperature, the control section 210 stops the low electric power drive of the lamp heater 480 (step S263), and repeats the operation of the step S262. When the measured temperature value is less than the toilet seat set temperature, the control section 210 repeats the operation of the step S144.

The operations (FIG. 21) of the steps S141 to S144 and S261 to S263 correspond to the operations of the control section 210 during the first seating period D6 mentioned above.

When two minutes elapse in the step S144, the control section 210 judges whether a user leaves the toilet seat section 400 by using the seat sensor 290 (step 3151).

Then, when a user leaves the toilet seat section 400, the control section 210 stops the drive of the lamp heater 480 (step S271), and performs the operation of the step S101.

Then, when a user leaves the toilet seat section 400, the control section 210 turns on the timer (step S270*a*), and judges again whether the user sits on the toilet seat section 400 by using the seat sensor 290 (step S270*b*).

When a user does not sit, the control section 210 judges whether 30 seconds elapse or not by using the timer (step S270*c*). When 30 seconds do not elapse, the control section 210 repeats the operation of the step S270*b*. Meanwhile, when 30 seconds elapse, the control section 210 stops the drive of the lamp heater 480 (step S251), and performs the operation of the step S101.

In addition, When the user sits on the toilet seat section 400 in the step S270*b*, the control section 210 performs the operation of the step S241.

In this manner, the control section 210 performs the operations of the steps S270*a* to S270*c*, and thus a user can sits on the toilet seat section 400 again without a sense of incongruity even when the user instantly stands up from the toilet seat section 400.

When the other user immediately sits on the seat after a first user leaves the toilet seat section 400, the other user can sit on the toilet seat section 400 of which temperature is increased.

Meanwhile, when a user does not leave the toilet seat section 400 in the step S151, the control section 210 performs the low electric power drive on the lamp heater 480 (step S152). Then, the control section 210 acquires the measured temperature value (step S153), and judges whether the measured temperature value is not less than the maintenance temperature or not (step S154).

When the measured temperature value is not less than the maintenance temperature, the control section 210 stops the low electric power drive of the lamp heater 480 (step S155), and repeats the operation of the step S154. When the measured temperature value is less than the maintenance temperature, the control section 210 repeats the operation of the step S151.

The operations (FIG. 22) of the steps S151 to S155 correspond to the operations of the control section 210 during the second seating period D7 and the second maintenance period D8 mentioned above.

In addition, operations that are the same as the steps S142 to S144 and S261 to S263 may be inserted between the step S151 and the step S152.

The operations (FIGS. 17, 21, and 22) of the steps S101, S102, S201 to S203, S251, and S271 correspond to the operations of the control section 210 during the stop period D9 mentioned above.

(10) Advantages

As described above, in the toilet seat device 100 according to the embodiment, it is not necessary to constantly maintain the temperature of the toilet seat section 400 at the toilet seat set temperature. Accordingly, in the standby periods D1 and D10 (FIG. 16) while a user does not enter the toilet, it is possible to sufficiently decrease the current for driving the lamp heater 480.

With such a configuration, even when the heating function of the toilet seat device 100 is turned on, the electric power consumption is sufficiently reduced. As a result, it is possible to save energy.

The applicant performed an experiment of electric power consumption (the electric power consumption for driving the lamp heater 480) in the toilet seat device that constantly maintains the surface temperature of the seating section 410T at the toilet seat set temperature, where the amount of electric power consumption was about 125 W/h. On the contrary, the amount of the electric power consumption (the electric power consumption for driving the lamp heater 480) in the toilet seat device 100 according to the embodiment is decreased to about 42 W/h.

The control section 210 of the toilet seat device 100 performs the 1200 W drive on the lamp heater 480 thereby increasing the surface temperature of the seating section 410T to the limit temperature in a short time. Then, the control section 210 performs the 600 W drive on the lamp heater 480 thereby increasing the surface temperature of the seating section 410T along the temperature gradient slightly lower than that at the time of the 1200 W drive.

With such a configuration, the overshoot caused by temperature variance of the seating section 410T is sufficiently reduced. As a result, the surface temperature of the seating section 410T accurately increases in a short time, and stabilizes at the toilet seat set temperature.

(11) Other Exemplary Configuration

In the embodiment, the lamp heater 480 is used in order to increase the surface temperature of the seating section 410T, but a heater having a electric heating coil may be used instead of the lamp heater 480 if the heater can instantly increase the surface temperature of the seating section 410T.

The lamp heater 480 is driven with 1200 W, 600 W, and the electric power that is sufficiently lower than those of 1200 W drive and 600 W drive, but the electric power for driving the lamp heater 480 is not limited to them. The electric power for driving the lamp heater 480 may be set in accordance with the rated electric powers.

(12) Correspondence Relationship between Components of Claims and Embodiment

In the toilet seat device 100 and toilet apparatus 1000 according to the embodiment as described above, the toilet seat section 400 corresponds to the toilet seat section, the lamp heater 480 corresponds to the heating element, the entry sensor 600 corresponds to the a human body sensing section, the control section 210 and the heater driving section 230 correspond to the control section, the surface temperature of the seating section 410T corresponds to the temperature of the toilet seat section, the limit temperature (29° C.) corresponds to the first temperature, the electric power of 1200 W corresponds to the first electric power, duration of the 1200 W drive set as a motor control pattern corresponds to the first time period, the toilet seat set temperature (34° C., 36° C. and 38° C.) corresponds to the second temperature, the electric power of 600 W corresponds to the second electric power, and duration of the 600 W drive set as the motor control pattern corresponds to the second time period.

Thermistor 411 and the temperature measurement section 220 corresponds to the toilet seat temperature measuring device, the heater control tables and the heater control patterns correspond to the temperature measured by the toilet seat temperature measuring device and the correspondence relationship between first and second time periods, the memory section included in the control section 210 corresponds to the memory section, the conversion temperature corresponds to the third temperature, the low electric power in the range of 0 to 50 W corresponds to the third electric power, the target temperature corresponds to the fourth temperature, and the seat sensor 290 corresponds to the seating sensing section.

Embodiment 2

Figure 23:
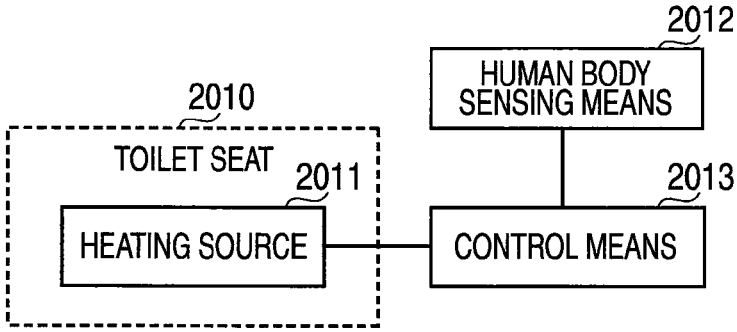
FIG. 23 is a block diagram illustrating the toilet seat device according to Embodiment 2 of the invention.
Figure 24:
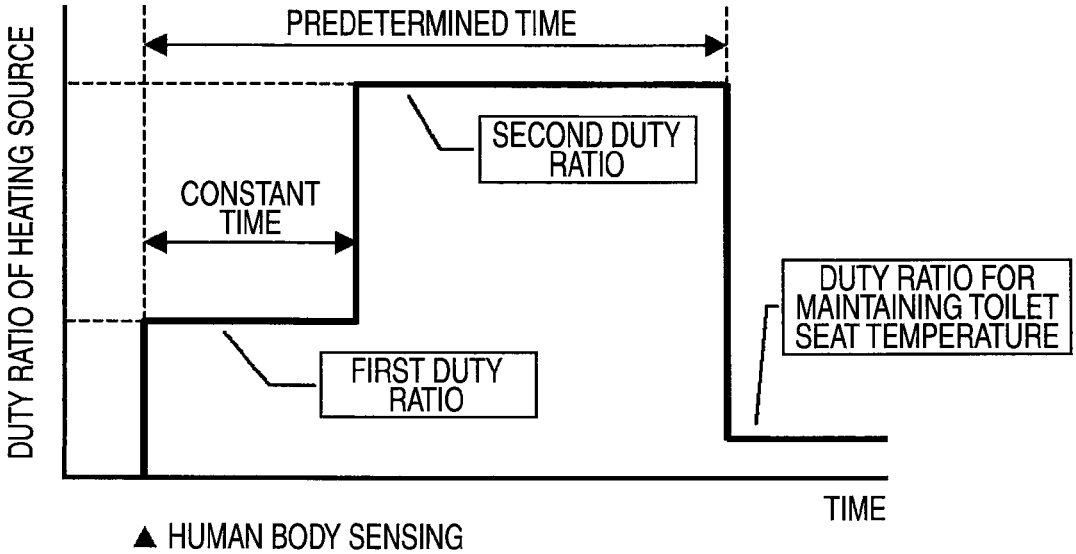
FIG. 24 is a graph illustrating duty ratio of the heating source according to Embodiment 2 of the invention.

FIG. 23 is a block diagram illustrating the toilet seat device according to Embodiment 2 of the invention. FIG. 24 is a graph illustrating duty ratio of the heating source according to Embodiment 2 of the invention.

As shown in FIG. 23, there is provided: a heating source 2011 for warming the toilet seat 2010; human body sensing means 2012 for sensing a human body; and control means 2013 for controlling the heating source and the human body sensing means.

Hereinafter, operations and functions of the toilet seat device configured as described above will be described.

The heating source 2011 is built in the toilet seat 2010, and warms the toilet seat 2010 by using the heating source 2011. Human body sensing means 2012 detects whether a user is in the toilet or not, and outputs user's existence in the toilet as a signal to the control means 2013. The control means 2013 includes micro computers and peripheral circuits, and controls electric power supply to the heating source 2011 on the basis of the output signal of the human body sensing means 2012.

As shown in FIG. 24, when the human body sensing means 2012 senses a human body, the control means 2013 allows electric power to be supplied to the heating source 2011 that warms the toilet seat 2010 for constant time with a first duty ratio. After the constant time, control means 2013 controls the electric power supply operation so that temperature of the toilet seat 2010 reaches seatable temperature with a second duty ratio higher than the first duty ratio in a predetermined time. After the predetermined time elapses from the start time of applying current to the heating source 2011, the electric power supply operation is performed with the duty ratio for maintaining temperature of the toilet seat 2010 at the set temperature. In addition, the seatable temperature is defined as the minimum temperature at which a user does not feel unpleasant when the user sits on the toilet seat 2010.

Generally, it can be considered that current is applied to the heating source 2011 with the second duty ratio from the start time of applying the current, in order that temperature of the toilet seat 2010 reaches the seatable temperature as soon as possible. However, as described in the above-mentioned problems, resistance of the heating source 2011 is as very small as 1/10 the resistance at the time of rated electric power consumption when the heating source 2011 is cooled down (temperature corresponding to room temperature in the toilet), and thus large inrush current flows in the initial time period of applying current. In addition, when another product (particularly, the product having a heater formed therein) is used at the same time in the toilet, it is considered that larger current flows. Generally, since a house power wiring with respect to the toilet inside is not a large current wiring but a single power wiring, there are not usually provided a circuit breaker and an overcurrent breaker for dealing with the large current. In addition, generally, current is also applied to lighting apparatuses in the toilet from the same electric power wiring. For this reason, when current is applied to the heating source 2011 and heaters of the other products (for example, a hot water heater for heating washing water that washes a part of a human body) equipped in the toilet simultaneously, the circuit breaker is operated by overcurrent, and voltage drop is caused by resistance components of the house power wiring. Therefore, there are cases of: supply voltage drop to a toilet seat device, other products equipped in toilet, and lighting in toilet; product performance deterioration of toilet seat device or other products equipped in toilet; and brightness down of indoor lighting.

Generally, the resistance of the heating source 2011 reaches a rated resistance in a short time, and the inrush current is immediately suppressed. Thus, electric power is supplied to the heating source 2011 with the first duty ratio at the start time of applying current, and then the control operation is performed with the second duty ratio that is higher than the first duty ratio, thereby suppressing large inrush current. Therefore, there is no problem that the circuit breaker is operated by overcurrent, or voltage drop is caused by resistance components of the house power wiring. Thus, there is no supply voltage drop to a toilet seat device, other products equipped in toilet, and lighting in toilet, no product performance deterioration of toilet seat device or other products equipped in toilet, and no brightness down of indoor lighting. As a result, it is possible to provide a toilet seat device that is convenient for use and can save more energy.

In addition, since current is not unnecessarily applied to the heating source by switching to the minimum electric power that is necessary to maintain the toilet seat temperature at the seatable temperature, it is possible to achieve a toilet seat device that can save more energy.

Embodiment 3

Figure 25:
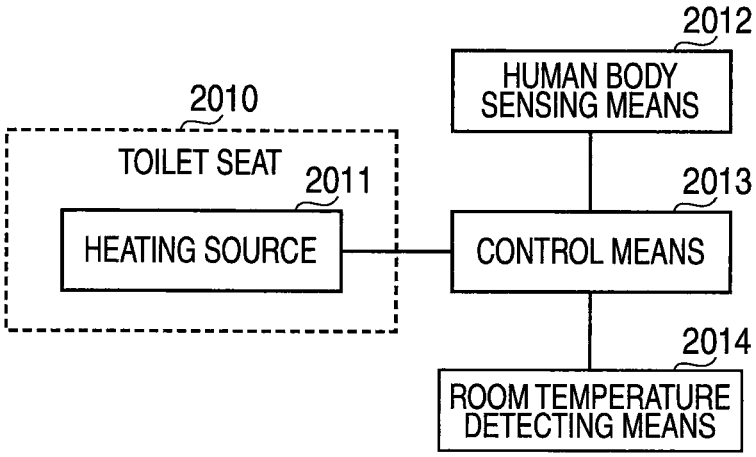
FIG. 25 is a block diagram illustrating the toilet seat device according to Embodiment 3 of the invention.

FIG. 25 is a block diagram illustrating the toilet seat device according to Embodiment 3 of the invention.

As shown in FIG. 25, there is provided room temperature detecting means 2014 for detecting room temperature, and the control means 2013 determines a predetermined time for applying current to the heating source 2011 in accordance with the room temperature detected by the room temperature detecting means 2014.

Figure 26:
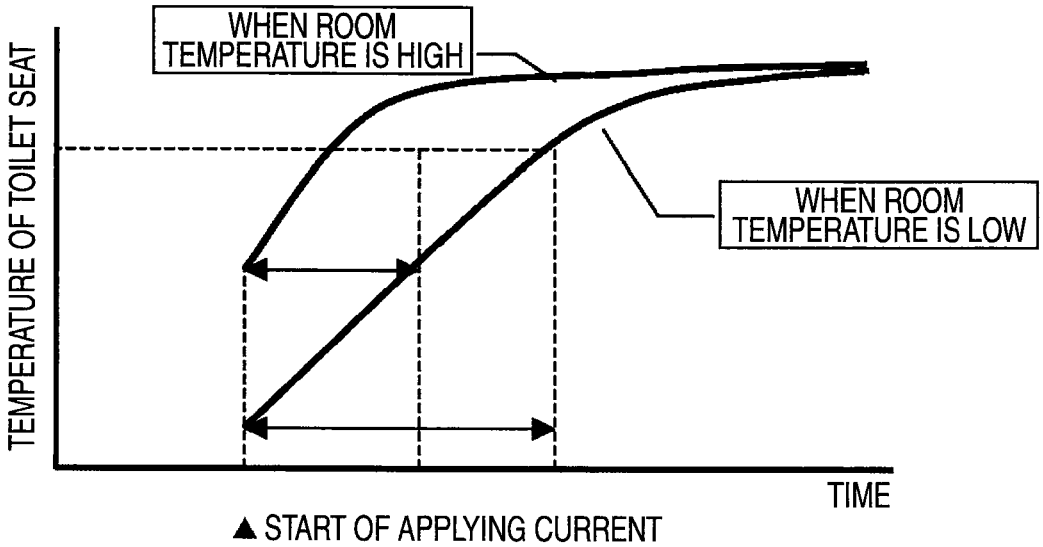
FIG. 26 is a graph illustrating variance of toilet seat temperature according to Embodiment 3 of the invention.

FIG. 26 is a graph illustrating variance of toilet seat temperature according to Embodiment 3 of the invention.

As shown in FIG. 26, since there is a difference in temperature of the toilet seat 2010 at the time immediately before a human body is sensed and current is applied to the heating source 2011, in cases where the room temperature is high and low. Therefore, the time periods corresponding to the cases are also different until temperature of the toilet seat 2010 reaches the seatable temperature after current is applied to the heating source 2011. For example, when the room temperature is low, the temperature of the toilet seat 2010 is also low, and speed of a rise in the temperature of the toilet seat 2010 is also low. Therefore, it is necessary to apply current to the heating source 2011 in a long time when the temperature of the toilet seat 2010 reaches the seatable temperature. However, when current is applied to the heating source 2011 in the same time period in the case of high room temperature, the temperature of the toilet seat 2010 exceeds the seatable temperature. Conversely, when the room temperature is high, the temperature of the toilet seat 2010 is also high, and speed of a rise in the temperature of the toilet seat 2010 is also high. Therefore, it is possible to apply current to the heating source 2011 in a short time when the temperature of the toilet seat 2010 reaches the seatable temperature. However, when current is applied to the heating source 2011 in the same time period in the case of low room temperature, the temperature of the toilet seat 2010 does not reach the seatable temperature.

Accordingly, the control means 2013 determines a predetermined time for applying current to the heating source 2011 in accordance with room temperature. Therefore, the temperature of the toilet seat 2010 reaches seatable temperature in a minimum time for necessary, and thus it is possible to provide a convenient toilet seat device. In addition, since current is not unnecessarily applied to the heating source 2011, it is possible to achieve a toilet seat device that can save more energy.

Embodiment 4

Figure 27:
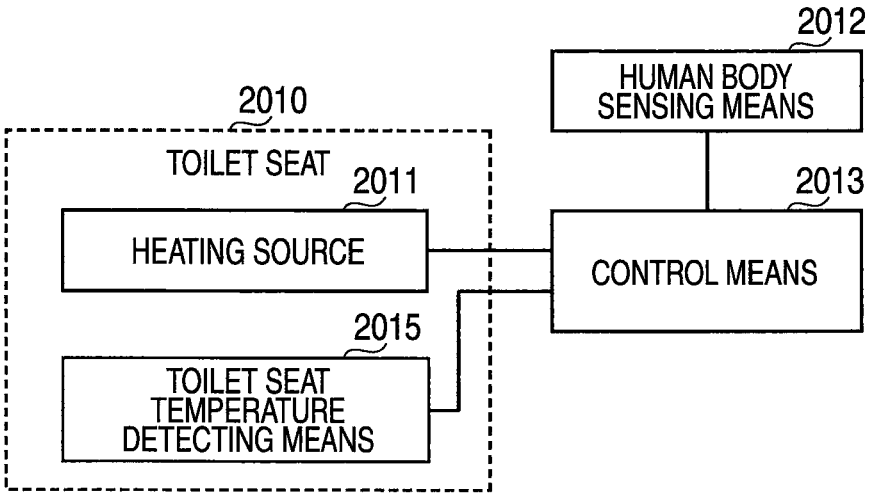
FIG. 27 is a block diagram illustrating the toilet seat device according to Embodiment 4 of the invention.

FIG. 27 is a block diagram illustrating the toilet seat device according to Embodiment 4 of the invention.

As shown in FIG. 27, the toilet seat 2010 includes toilet seat temperature detecting means 2015 for detecting the temperature of the toilet seat 2010, and the control means 2013 determines a predetermined time for applying current to the heating source 2011 in accordance with the toilet seat temperature detected by the toilet seat temperature detecting means 2015.

Generally, when the heating source 2011 warms the toilet seat 2010 once, a certain time period is needed until the temperature of the toilet seat 2010 decreases in a case where a user stops supply of electric power to the heating source 2011 after use. In practical use, there are various time intervals whenever the toilet seat device is used in accordance with an installation environment, a time zone, and the like. For example, in the morning time zone of a family having four members, the toilet seat device is continuously used in the same time zone in order to go to school or work. In addition, when a toilet seat device is installed in public facilities and the like where people frequently come and go, the toilet seat device is continuously used. In these cases, since the time interval whenever the toilet seat device is used is very short, applying current to the heating source 2011 starts in a state where the temperature of the toilet seat 2010 is sufficiently high. Even in this case, current is unnecessarily applied when the predetermined time for applying current to the heating source 2011 is set as the same time, electric power is uselessly consumed.

Accordingly, the control means 2013 determines a predetermined time for applying current to the heating source 2011 in accordance with temperature of the toilet seat 2010. Therefore, the temperature of the toilet seat 2010 reaches seatable temperature in a minimum time for necessary, and thus it is possible to provide a convenient toilet seat device. In addition, since current is not unnecessarily applied to the heating source 2011, it is possible to achieve a toilet seat device that can save more energy.

In the embodiment, the toilet seat temperature detecting means 2015 is installed in the toilet seat, but the invention is not limited to this, and it is possible to obtain the same advantage when the means is located at a position such as the surface section of the toilet seat having high correlationship with the surface temperature of the toilet seat.

Embodiment 5

Figure 28:
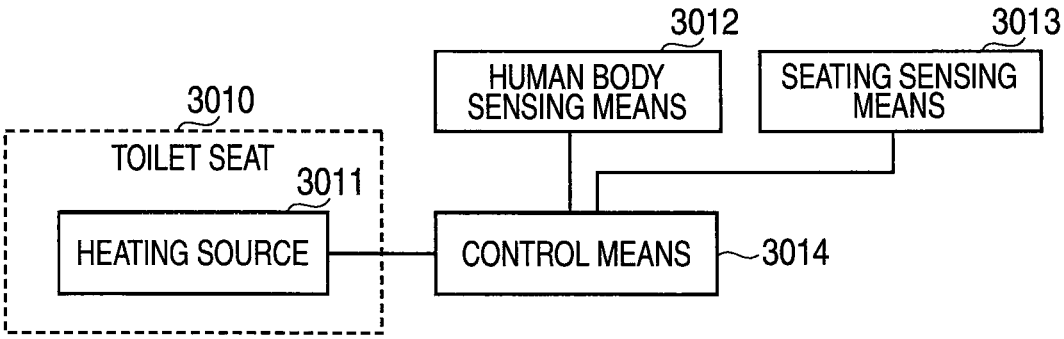
FIG. 28 is a block diagram illustrating the toilet seat device according to Embodiment 5 of the invention.
Figure 29:
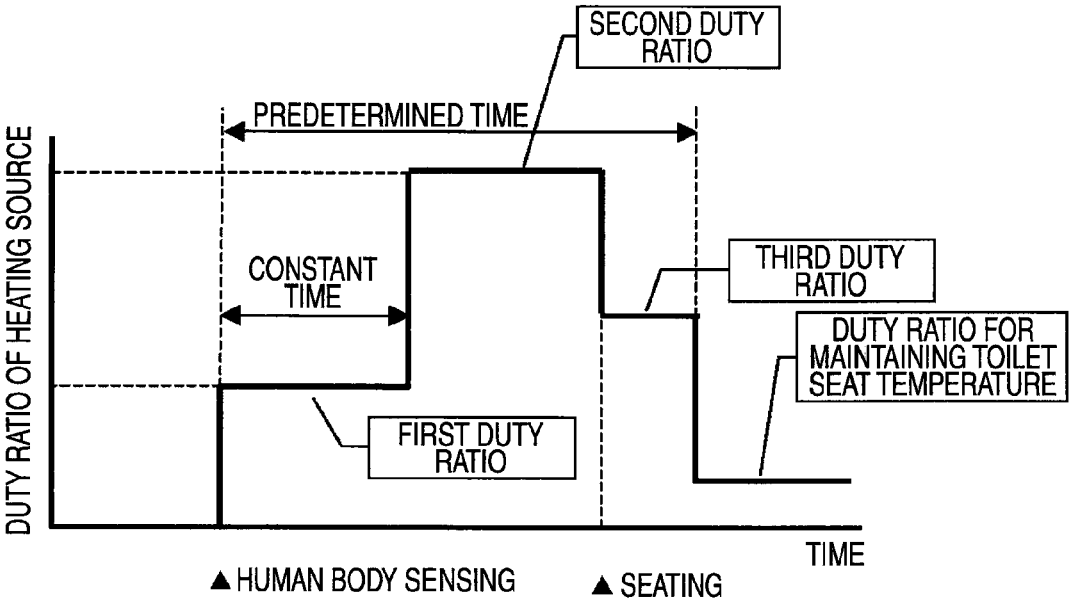
FIG. 29 is a graph illustrating duty ratio of the heating source according to Embodiment 5 of the invention.

FIG. 28 is a block diagram illustrating the toilet seat device according to Embodiment 5 of the invention. FIG. 29 is a graph illustrating duty ratio of the heating source 3011 according to Embodiment 5 of the invention.

As shown in FIG. 28, there are provided a heating source 3011 for warming the toilet seat 3010, human body sensing means 3012 for sensing a human body, and control means 3014 for controlling the seating sensing means 3013 that detects user's seating.

Hereinafter, operations and functions of the toilet seat device configured as described above will be described.

The heating source 3011 is built in the toilet seat 3010, and warms the toilet seat 3010 by using the heating source 3011. Human body sensing means 3012 detects whether a user is in the toilet or not, and outputs user's existence in the toilet as a signal to the control means 3014. The seating sensing means 3013 detects whether the user sits on the toilet seat device or not, and outputs user's seating/no-seating state as a signal to the control means 3014. The control means 3014 includes micro computers and peripheral circuits, and controls electric power supply to the heating source 3011 on the basis of the output signals of the human body sensing means 3012 and the seating sensing means 3013.

As shown in FIG. 29, when the human body sensing means 3012 senses a human body, the control means 3014 allows electric power to supply to the heating source 3011 that warms the toilet seat 3010 for constant time with a first duty ratio. After the constant time, control means 3014 controls the electric power supply operation so that temperature of the toilet seat 3010 reaches seatable temperature with a second duty ratio higher than the first duty ratio in a predetermined time. In addition, when the seating sensing means 3013 senses a human body's seating on the toilet seat 3010, the control means 3014 controls the duty ratio of the heating source 3011 as a third duty ratio lower than the second duty ratio. After the predetermined time elapses from the start time of applying current to the heating source 3011, the electric power supply operation is performed with the duty ratio for maintaining temperature of the toilet seat 3010 at the set temperature. In addition, the seatable temperature is defined as the minimum temperature at which a user can not feel unpleasant when the user sits on the toilet seat 3010.

Generally, it can be considered that current is applied to the heating source 3011 with the second duty ratio from the start time of applying the current, in order that temperature of the toilet seat 3010 reaches the seatable temperature as soon as possible. However, as described in the above-mentioned problems, resistance of the heating source 3011 is as very small as 1/10 the resistance at the time of rated electric power consumption when the heating source 3011 is cooled down (temperature corresponding to room temperature in the toilet), and thus large inrush current flows in the initial time period of applying current. In addition, when another product (particularly, the product having a heater formed therein) is used at the same time in the toilet, it is considered that larger current flows. Generally, since a house power wiring with respect to the toilet inside is not a large current wiring but a single power wiring, there are not usually provided a circuit breaker and an overcurrent breaker for dealing with the large current. In addition, generally, current is also applied to lighting apparatuses in the toilet from the same electric power wiring. For this reason, when current is applied to the heating source 3011 and heaters of the other products (for example, a hot water heater for heating washing water that washes a part of a human body) equipped in the toilet simultaneously, the circuit breaker is operated by overcurrent, and voltage drop is caused by resistance components of the house power wiring. Therefore, there are cases of: supply voltage drop to a toilet seat device, other products equipped in toilet, and lighting in toilet; product performance deterioration of toilet seat device or other products equipped in toilet; and brightness down of indoor lighting.

Generally, the resistance of the heating source 3011 reaches a rated resistance in a short time, and the inrush current is immediately suppressed. Thus, electric power is supplied to the heating source 3011 with the first duty ratio at the start time of applying current, and then the control operation is performed with the second duty ratio that is higher than the first duty ratio, thereby suppressing large inrush current. Therefore, there is no problem that the circuit breaker is operated by overcurrent, or voltage drop is caused by resistance components of the house power wiring. Thus, there is no supply voltage drop to a toilet seat device, other products equipped in toilet, and lighting in toilet, no product performance deterioration of toilet seat device or other products equipped in toilet, and no brightness down of indoor lighting. As a result, it is possible to provide a toilet seat device that is convenient for use and can save more energy.

In addition, the surface states of the toilet seat 3010 of the time when a human body sits on the toilet seat 3010 and a human body does not sit thereon are different, and thus there is a difference in temperature of the toilet seat 3010. In addition, the toilet seat 3010 is covered by the human body when a human body is sitting on the toilet seat 3010, so that heat retaining property increases and body temperature warms the toilet seat, and thus the surface temperature of the toilet seat 3010 is warm as compared with the time when a human body does not sit thereon.

In the control means 3014, when the seating sensing means 3013 senses user's seating, electric power is supplied to the heating source 3011 with the third duty ratio lower than the second duty ratio, thereby suppressing useless electric power. Therefore, it is possible to provide a toilet seat device that is convenient for use and can save more energy.

Embodiment 6

Figure 30:
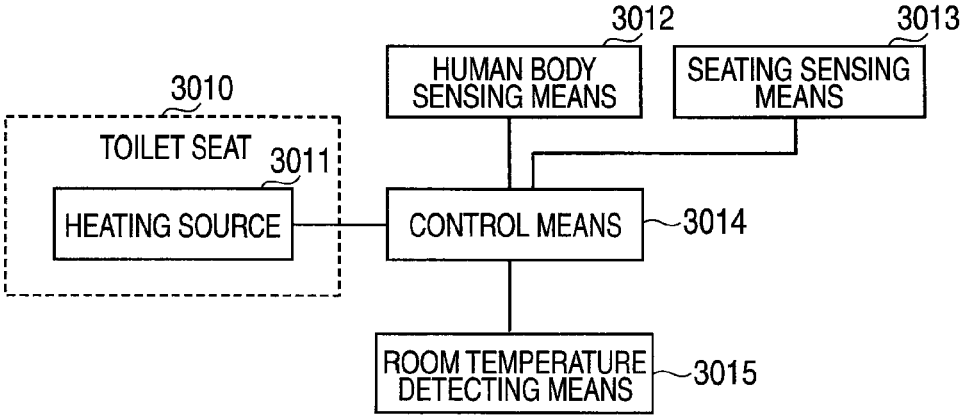
FIG. 30 is a block diagram illustrating the toilet seat device according to Embodiment 6 of the invention.
Figure 31:
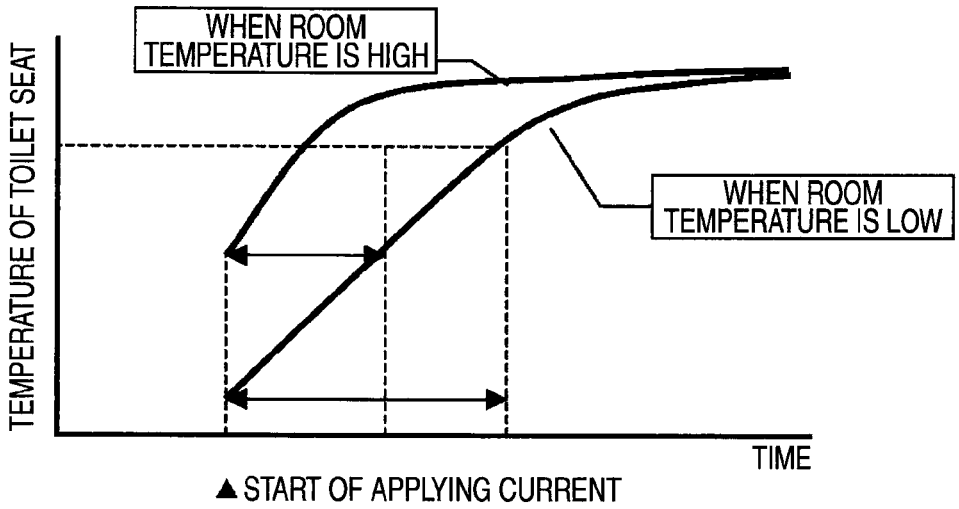
FIG. 31 is a graph illustrating variance of the toilet seat temperature according to Embodiment 6 of the invention.

FIG. 30 is a block diagram illustrating the toilet seat device according to Embodiment 6 of the invention. FIG. 31 is a graph illustrating variance of the toilet seat temperature according to Embodiment 6 of the invention.

As shown in FIG. 30, there is provided room temperature detecting means 3015 for detecting room temperature, and the control means 3014 determines a predetermined time for applying current to the heating source 3011 in accordance with the room temperature detected by the room temperature detecting means 3015.

As shown in FIG. 31, since there is a difference in temperature of the toilet seat 3010 at the time immediately before a human body is sensed and current is applied to the heating source 3011, in cases where the room temperature is high and low. Therefore, the time periods corresponding to the cases are also different until temperature of the toilet seat 3010 reaches the seatable temperature after current is applied to the heating source 3011. For example, when the room temperature is low, the temperature of the toilet seat 3010 is also low, and speed of a rise in the temperature of the toilet seat 3010 is also low. Therefore, it is necessary to apply current to the heating source 3011 in a long time when the temperature of the toilet seat 3010 reaches the seatable temperature. However, when current is applied to the heating source 3011 in the same time period in the case of high room temperature, the temperature of the toilet seat 3010 exceeds the seatable temperature. Conversely, when the room temperature is high, the temperature of the toilet seat 3010 is also high, and speed of a rise in the temperature of the toilet seat 3010 is also high. Therefore, it is possible to apply current to the heating source 3011 in a short time when the temperature of the toilet seat 3010 reaches the seatable temperature. However, when current is applied to the heating source 3011 in the same time period in the case of low room temperature, the temperature of the toilet seat 3010 does not reach the seatable temperature.

Accordingly, the control means 3014 determines a predetermined time for applying current to the heating source 3011 in accordance with room temperature. Therefore, the temperature of the toilet seat 3010 reaches seatable temperature in a minimum time for necessary, and thus it is possible to provide a convenient toilet seat device. In addition, since current is not unnecessarily applied to the heating source 3011, it is possible to achieve a toilet seat device that can save more energy.

Embodiment 7

Figure 32:
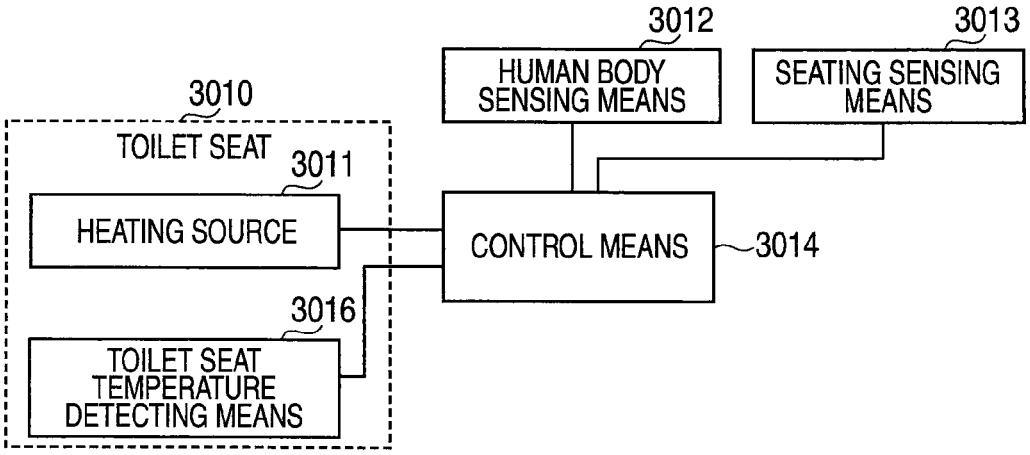
FIG. 32 is a block diagram illustrating the toilet seat device according to Embodiment 7 of the invention.

FIG. 32 is a block diagram illustrating the toilet seat device according to Embodiment 7 of the invention.

As shown in FIG. 32, there is provided toilet seat temperature detecting means 3016 for detecting the temperature of the toilet seat 3010, and the control means 3014 determines a predetermined time for applying current to the heating source 3011 in accordance with the toilet seat temperature detected by the toilet seat temperature detecting means 3016.

Generally, when the heating source 3011 warms the toilet seat 3010 once, a certain time period is needed until the temperature of the toilet seat 3010 decreases in a case where a user stops supply of electric power to the heating source 3011 after use. In practical use, there are various time intervals whenever the toilet seat device is used in accordance with an installation environment, a time zone, and the like. For example, in the morning time zone of a family having four members, the toilet seat device is continuously used in the same time zone in order to go to school or work. In addition, when a toilet seat device is installed in public facilities and the like where people frequently come and go, the toilet seat device is continuously used. In these cases, since the time interval whenever the toilet seat device is used is very short, applying current to the heating source 3011 starts in a state where the temperature of the toilet seat 3010 is sufficiently high. Even in this case, current is unnecessarily applied when the predetermined time for applying current to the heating source 3011 is set as the same time, electric power is uselessly consumed.

Accordingly, the control means 3014 determines a predetermined time for applying current to the heating source 3011 in accordance with temperature of the toilet seat 3010. Therefore, the temperature of the toilet seat 3010 reaches seatable temperature in a minimum time for necessary, and thus it is possible to provide a convenient toilet seat device. In addition, since current is not unnecessarily applied to the heating source 3011, it is possible to achieve a toilet seat device that can save more energy.

In the embodiment, the toilet seat temperature detecting means 3016 is installed in the toilet seat, but the invention is not limited to this, and it is possible to obtain the same advantage when the means is located at a position such as the surface section of the toilet seat having high correlationship with the surface temperature of the toilet seat.

Embodiment 8

Figure 33:
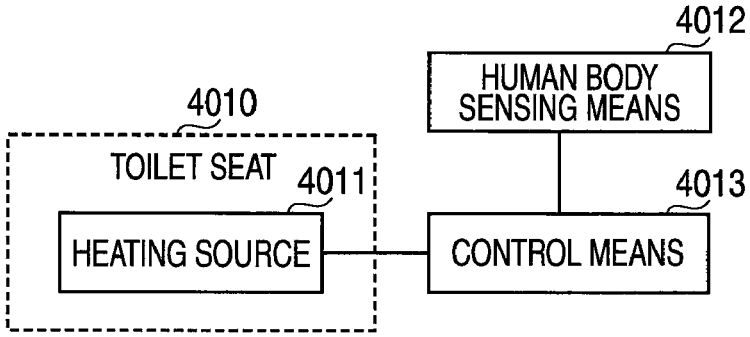
FIG. 33 is a block diagram illustrating the toilet seat device according to Embodiment 8 of the invention.
Figure 34:
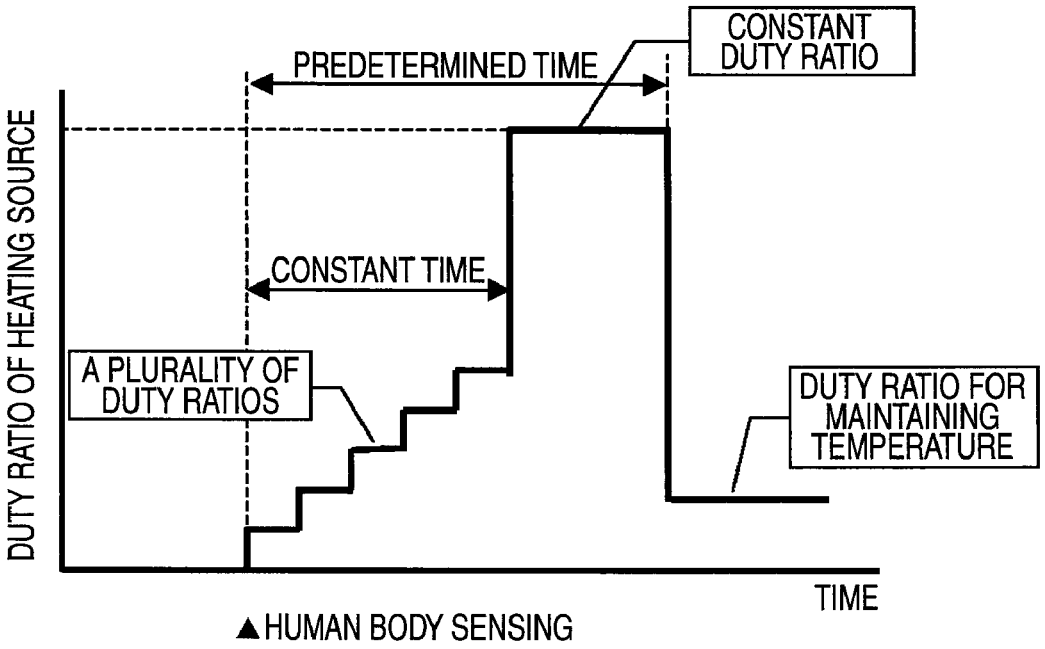
FIG. 34 is a graph illustrating duty ratio of the heating source according to Embodiment 8 of the invention.

FIG. 33 is a block diagram illustrating the toilet seat device according to Embodiment 8 of the invention. FIG. 34 is a graph illustrating duty ratio of the heating source according to Embodiment 8 of the invention.

As shown in FIG. 33, there is provided: a heating source 4011 for warming the toilet seat 4010; human body sensing means 4012 for sensing a human body; and control means 4013 for controlling the heating source and the human body sensing means.

Hereinafter, operations and functions of the toilet seat device configured as described above will be described.

The heating source 4011 is built in the toilet seat 4010, and warms the toilet seat 4010 by using the heating source 4011. Human body sensing means 4012 detects whether a user is in the toilet or not, and outputs user's existence in the toilet as a signal to the control means 4013. The control means 4013 includes micro computers and peripheral circuits, and controls electric power supply to the heating source 4011 on the basis of the output signal of the human body sensing means 4012.

As shown in FIG. 34, when the human body sensing means 4012 senses a human body, the control means 4013 stepwise increases the electric power for supplying to the heating source 4011, which warms the toilet seat 4010, by using a plurality of duty ratios, and allows the electric power to be supplied for constant time. After the constant time, the control means 4013 controls the electric power supply operation so that temperature of the toilet seat 4010 reaches seatable temperature with a constant duty ratio higher than the plurality of duty ratios in a predetermined time. After the predetermined time elapses from the start time of applying current to the heating source 4011, the electric power supply operation is performed with the duty ratio for maintaining temperature of the toilet seat 4010 at the set temperature. In addition, the seatable temperature is defined as the minimum temperature at which a user can not feel unpleasant when the user sits on the toilet seat 4010.

Generally, it can be considered that current is applied to the heating source 4011 with the constant duty ratio from the start time of applying the current, in order that temperature of the toilet seat 4010 reaches the seatable temperature as soon as possible. However, as described in the above-mentioned problems, resistance of the heating source 4011 is as very small as 1/10 the resistance at the time of rated electric power consumption when the heating source 4011 is cooled down (temperature corresponding to room temperature in the toilet), and thus large inrush current flows in the initial time period of applying current. In addition, when another product (particularly, the product having a heater formed therein) is used at the same time in the toilet, it is considered that larger current flows. Generally, since a house power wiring with respect to the toilet inside is not a large current wiring but a single power wiring, there are not usually provided a circuit breaker and an overcurrent breaker for dealing with the large current. In addition, generally, current is also applied to lighting apparatuses in the toilet from the same electric power wiring. For this reason, when current is applied to the heating source 4011 and heaters of the other products (for example, a hot water heater for heating washing water that washes a part of a human body) equipped in the toilet simultaneously, the circuit breaker is operated by overcurrent, and voltage drop is caused by resistance components of the house power wiring. Therefore, there are cases of; supply voltage drop to a toilet seat device, other products equipped in toilet, and lighting in toilet; product performance deterioration of toilet seat device or other products equipped in toilet; and brightness down of indoor lighting.

Generally, the resistance of the heating source 4011 reaches a rated resistance in a short time, and the inrush current is immediately suppressed. Thus, electric power is supplied to the heating source 4011 with the plurality of duty ratios at the start time of applying current, and then the control operation is performed with the constant duty ratio that is higher than plurality of duty ratios, thereby suppressing large inrush current. Therefore, there is no problem that the circuit breaker is operated by overcurrent, or voltage drop is caused by resistance components of the house power wiring. Thus, there is no supply voltage drop to a toilet seat device, other products equipped in toilet, and lighting in toilet, no product performance deterioration of toilet seat device or other products equipped in toilet, and no brightness down of indoor lighting. As a result, it is possible to provide a toilet seat device that is convenient for use and can save more energy.

In addition, since current is not unnecessarily applied to the heating source by switching to a retentive duty ratio of the minimum electric power that is necessary to maintain the toilet seat temperature at the seatable temperature, it is possible to achieve a toilet seat device that can save more energy.

In the embodiment, the control operation is performed so that current is applied while the plurality of duty ratios are stepwise increased, but the invention is not limited to this. Accordingly, it is also possible to suddenly decrease the duty ratio in the process of an increase of the duty ratio or to extend the time period during applying current with the constant duty ratio. By performing the control operation mentioned above, it is possible to prevent the toilet seat from overheat.

Embodiment 9

Figure 35:
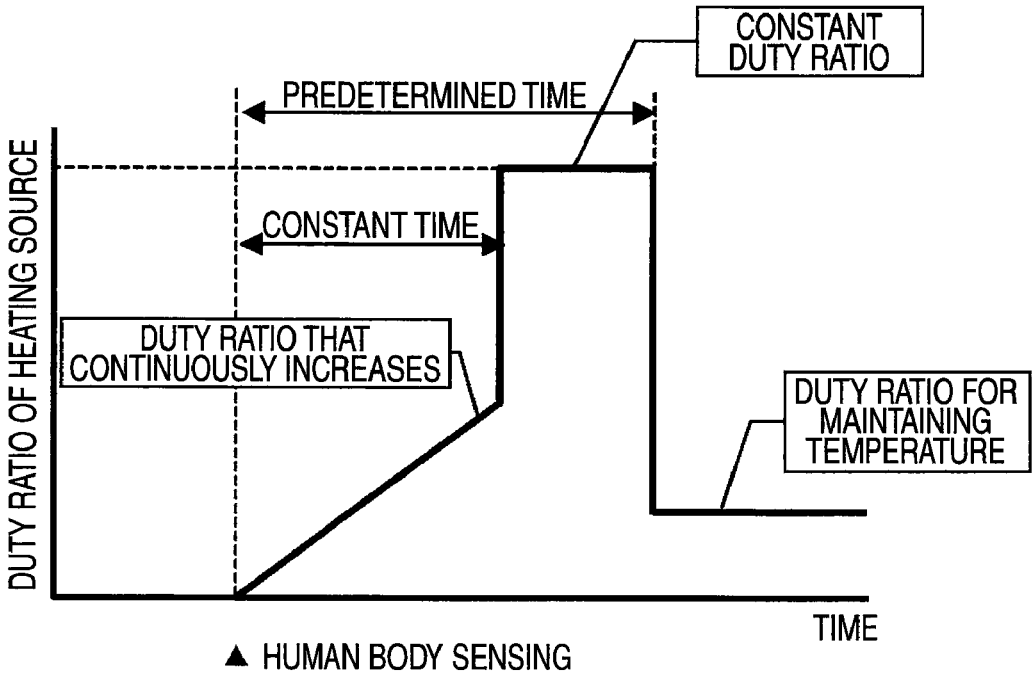
FIG. 35 is a graph illustrating duty ratio of the heating source according to Embodiment 9 of the invention.

FIG. 35 is a graph illustrating duty ratio of the heating source 4011 according to Embodiment 9 of the invention.

The embodiment is different from Embodiment 8 in view point of the following description. As shown in FIG. 35, when the human body sensing means 4012 senses a human body, the control means 4013 continuously increases duty ratio of the electric power for supplying to the heating source 4011 that warms the toilet seat 4010, and simultaneously allows the electric power to be supplied for constant time. After the constant time, the control means 4013 controls the electric power supply operation so that temperature of the toilet seat 4010 reaches seatable temperature with a constant duty ratio higher than the continuously increased duty ratio in a predetermined time.

As described above, resistance of the heating source 4011 is as very small as 1/10 the resistance at the time of rated electric power consumption when the heating source 4011 is cooled down (temperature corresponding to room temperature in the toilet), and thus large inrush current flows in the initial time period of applying current. However, the own temperature of the heating source 4011 is increased by heat generation of the heating source 4011 when current is applied to the heating source 4011. The resistance of the heating source 4011 gradually increases, thereby suppressing inrush current in accordance with resistance variance of the heating source 4011.

Accordingly, when the human body sensing means 4012 senses a human body, the control means 4013 continuously increases duty ratio of the electric power for supplying to the heating source 4011 that warms the toilet seat 4010. Therefore, the temperature of the toilet seat 4010 reaches seatable temperature in a minimum time for necessary, and thus it is possible to provide a convenient toilet seat device. In addition, since current is not unnecessarily applied to the heating source 4011, it is possible to achieve a toilet seat device that can save more energy.

Embodiment 10

Figure 36:
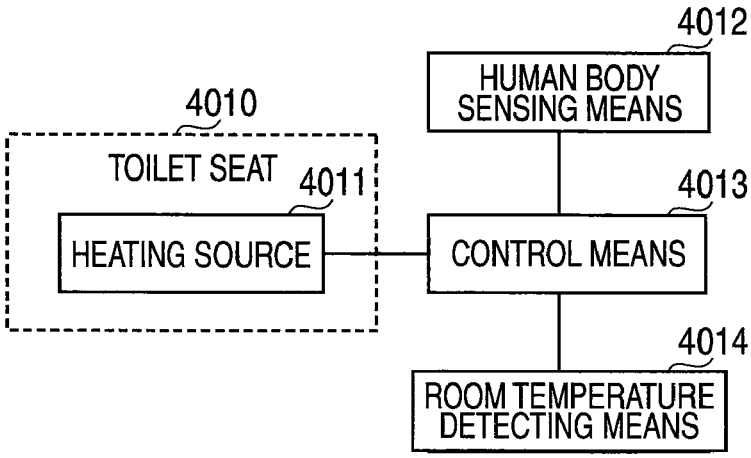
FIG. 36 is a block diagram illustrating the toilet seat device according to Embodiment 10 of the invention.
Figure 37:
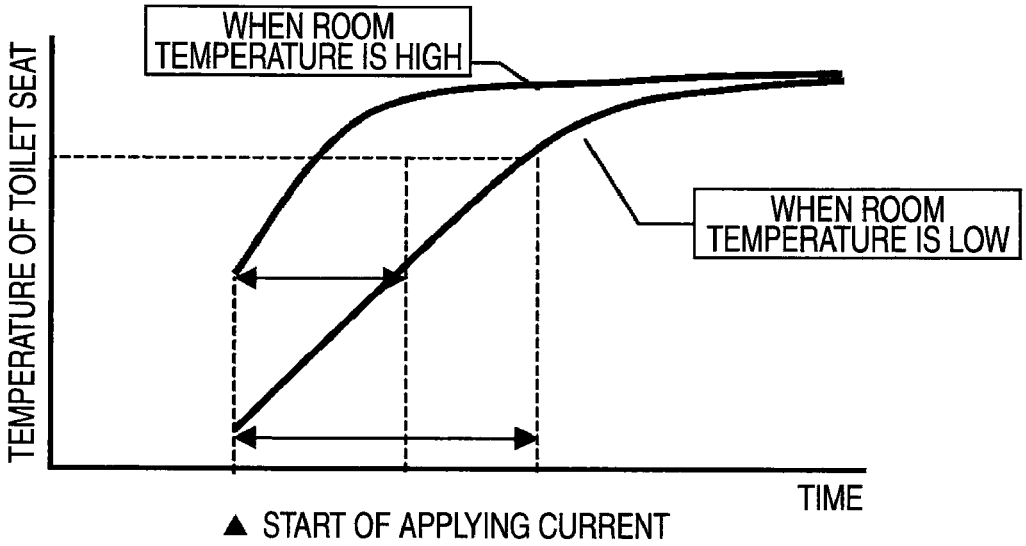
FIG. 37 is a graph illustrating variance of the toilet seat temperature according to Embodiment 10 of the invention.

FIG. 36 is a block diagram illustrating the toilet seat device according to Embodiment 10 of the invention. FIG. 37 is a graph illustrating variance of the toilet seat temperature according to Embodiment 10 of the invention.

As shown in FIG. 36, there is provided room temperature detecting means 4014 for detecting room temperature, and the control means 4013 determines a predetermined time for applying current to the heating source 4011 in accordance with the room temperature detected by the room temperature detecting means 4015.

As shown in FIG. 37, since there is a difference in temperature of the toilet seat 4010 at the time immediately before a human body is sensed and current is applied to the heating source 4011, in cases where the room temperature is high and low. Therefore, the time periods corresponding to the cases are also different until temperature of the toilet seat 4010 reaches the seatable temperature after current is applied to the heating source 4011. For example, when the room temperature is low, the temperature of the toilet seat 4010 is also low, and speed of a rise in the temperature of the toilet seat 4010 is also low. Therefore, it is necessary to apply current to the heating source 4011 in a long time when the temperature of the toilet seat 4010 reaches the seatable temperature. However, when current is applied to the heating source 4011 in the same time period in the case of high room temperature, the temperature of the toilet seat 4010 exceeds the seatable temperature. Conversely, when the room temperature is high, the temperature of the toilet seat 4010 is also high, and speed of a rise in the temperature of the toilet seat 4010 is also high. Therefore, it is possible to apply current to the heating source 4011 in a short time when the temperature of the toilet seat 4010 reaches the seatable temperature. However, when current is applied to the heating source 4011 in the same time period in the case of low room temperature, the temperature of the toilet seat 4010 does not reach the seatable temperature.

Accordingly, the control means 4013 determines a predetermined time for applying current to the heating source 4011 in accordance with room temperature. Therefore, the temperature of the toilet seat 4010 reaches seatable temperature in a minimum time for necessary, and thus it is possible to provide a convenient toilet seat device. In addition, since current is not unnecessarily applied to the heating source 4011, it is possible to achieve a toilet seat device that can save more energy.

Embodiment 11

Figure 38:
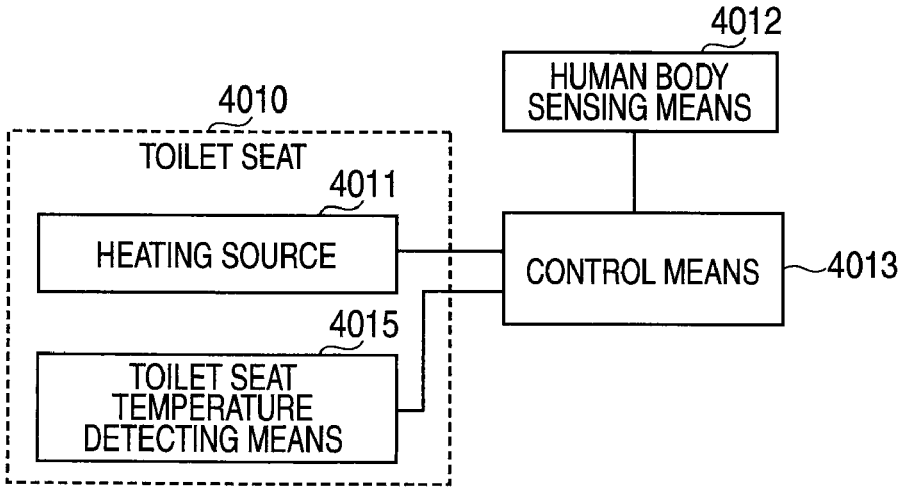
FIG. 38 is a block diagram illustrating the toilet seat device according to Embodiment 11 of the invention.
Figure 39:
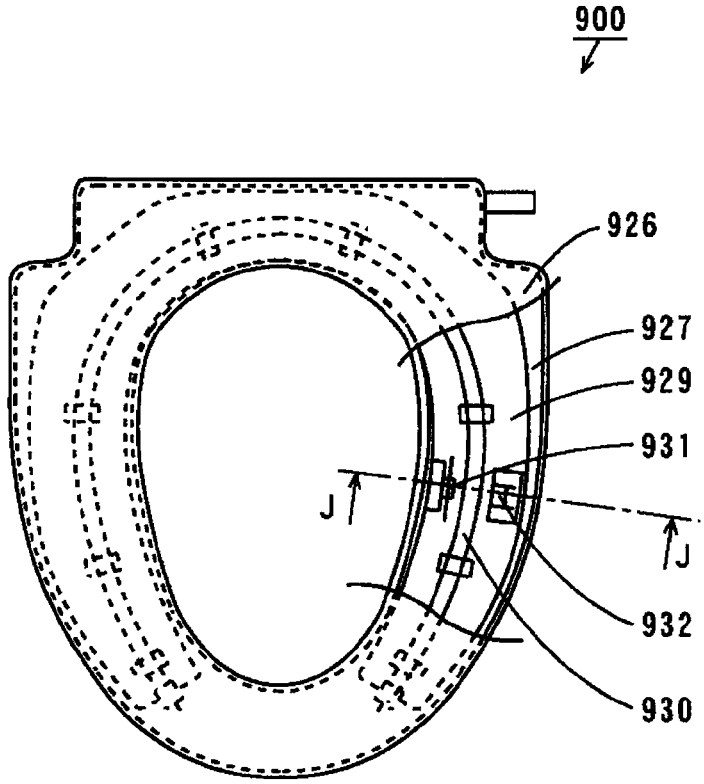
FIG. 39 is a notched top plan view illustrating a part of a warm toilet seat according to Patent Document 1.
Figure 40:
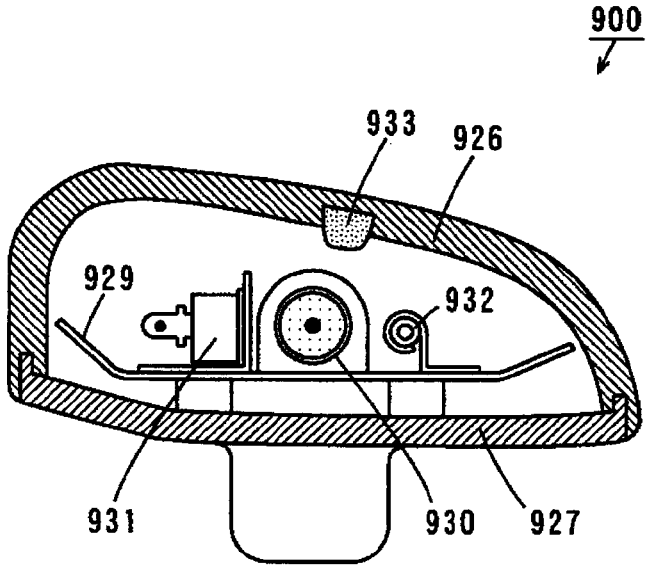
FIG. 40 is a sectional view taken along the line J-J in FIG. 39.
Figure 41:
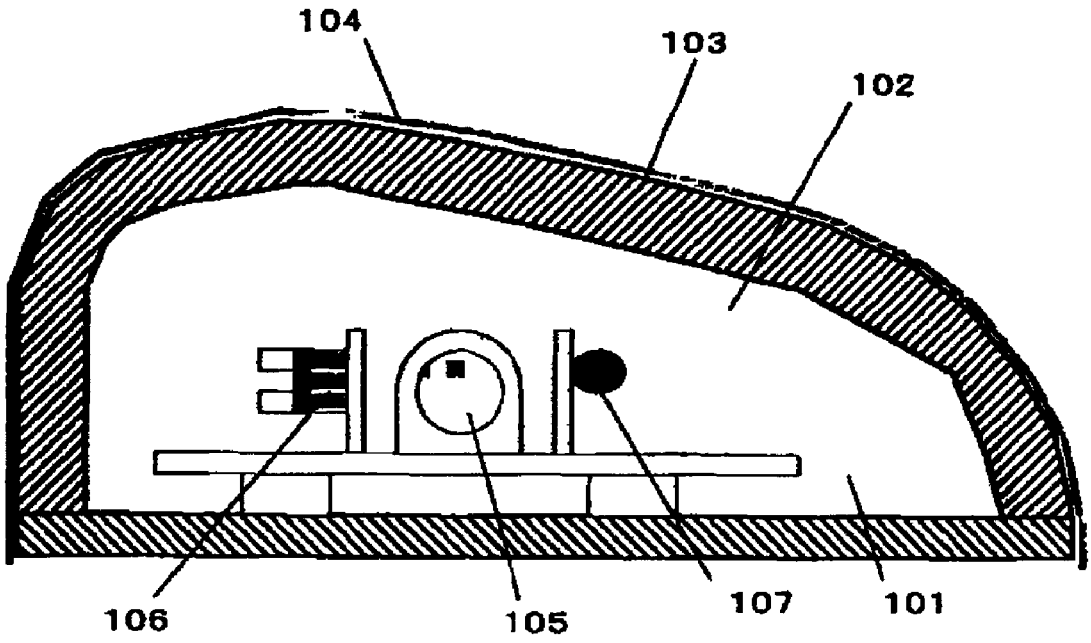
FIG. 41 is a sectional view illustrating a main part of a known toilet seat device.

FIG. 38 is a block diagram illustrating the toilet seat device according to Embodiment 11 of the invention.

As shown in FIG. 38, there is provided toilet seat temperature detecting means 4015 for detecting the temperature of the toilet seat 4010, and the control means 4013 determines a predetermined time for applying current to the heating source 4011 in accordance with the toilet seat temperature detected by the toilet seat temperature detecting means 4015.

Generally, when the heating source 4011 warms the toilet seat 4010 once, a certain time period is needed until the temperature of the toilet seat 4010 decreases in a case where a user stops supply of electric power to the heating source 4011 after use. In practical use, there are various time intervals whenever the toilet seat device is used in accordance with an installation environment, a time zone, and the like. For example, in the morning time zone of a family having four members, the toilet seat device is continuously used in the same time zone in order to go to school or work. In addition, when a toilet seat device is installed in public facilities and the like where people frequently come and go, the toilet seat device is continuously used. In these cases, since the time interval whenever the toilet seat device is used is very short, applying current to the heating source 4011 starts in a state where the temperature of the toilet seat 4010 is sufficiently high. Even in this case, current is unnecessarily applied when the predetermined time for applying current to the heating source 4011 is set as the same time, electric power is uselessly consumed.

Accordingly, the control means 4013 determines a predetermined time for applying current to the heating source 4011 in accordance with temperature of the toilet seat 4010. Therefore, the temperature of the toilet seat 4010 reaches seatable temperature in a minimum time for necessary, and thus it is possible to provide a convenient toilet seat device. In addition, since current is not unnecessarily applied to the heating source 4011, it is possible to achieve a toilet seat device that can save more energy.

In the embodiment, the toilet seat temperature detecting means 4015 is installed in the toilet seat, but the invention is not limited to this, and it is possible to obtain the same advantage when the means is located at a position such as the surface section of the toilet seat having high correlationship with the surface temperature of the toilet seat.

The invention has been described in detail with reference to specific embodiments, but, as might be expected, it is possible to add various modification and amendment without departing from spirit and gist of the invention. This application claims the benefit of priority under Japanese Patent Application No. 2005-189419 filed on Jun. 29, 2005, Japanese Patent Application No. 2005-189420 filed on Jun. 29, 2005, Japanese Patent Application No. 2005-189421 filed on June 2005, and Japanese Patent Application No. 2005-240311 filed on Aug. 22, 2005, which are hereby incorporated by reference in its entirety.

Industrial Applicability

The invention is useful as a heating device that is in contact with a human body. In addition, the invention can be used for applications such as other heating apparatuses since it is possible to control a heating source capable of saving more energy.

The invention claimed is:

1. A toilet seat device comprising:

a toilet seat section;

a heating element for heating the toilet seat section;

a human body sensing section for detecting a user; and a control section for controlling the heating element to be driven, wherein, when the human body sensing section detects a user, the control section drives the heating element during a first time period so as to increase temperature of the toilet seat section to first temperature along a first temperature gradient with first electric power, and then the control section drives the heating element during a second time period so as to increase temperature of the toilet seat section to second temperature, which is higher than the first temperature, along a second temperature gradient, with second electric power which is lower than the first electric power.

2. The toilet seat device according to claim 1, further comprising:

a toilet seat temperature measuring device for measuring the temperature of the toilet seat section; and a memory section for storing correspondence relationship between the first and second time periods and the temperature measured by the toilet seat temperature measuring device, wherein, when the human body sensing section detects a user, the control section reads out the corresponding first and second time periods from the memory section on the basis of the temperature measured by the toilet seat temperature measuring device, and the control section drives the heating element on the basis of the first and second time periods.

3. The toilet seat device according to claim 2, wherein the control section drives the heating element with the second electric power when the temperature measured by the toilet seat temperature measuring device reaches a predetermined third temperature, before the elapse of first time period.

4. The toilet seat device according to claim 1, wherein the control section drives the heating element with the first electric power by applying alternating current throughout entire cycle periods, and the control section drives the heating element with the second electric power by applying alternating current throughout a predetermined number of half cycle periods.

5. The toilet seat device according to claim 2, wherein the control section drives the heating element with third electric power, which is lower than the first and second electric powers, so as to constantly maintain the temperature of the toilet seat section at the second temperature, after the elapse of second time period.

6. The toilet seat device according to claim 5, wherein the control section drives the heating element with the third electric power when the temperature measured by the toilet seat temperature measuring device reaches a predetermined fourth temperature, before the elapse of second time period.

7. The toilet seat device according to claim 5, wherein the control section drives the heating element with third electric power by applying alternating current throughout a predetermined number of quarter or less cycle periods.

8. The toilet seat device according to claim 1, wherein the control section drives the heating element with electric power, which is lower than the first electric power, immediately before driving the heating element with the first electric power.

9. The toilet seat device according to claim 1, further comprising a seating sensing section for detecting user's seating state on the toilet seat section, wherein the control section drives the heating element so as to decrease the temperature of the toilet seat section when the seating sensing section detects user's seating on the toilet seat section.

10. The toilet seat device according to claim 1, wherein the second temperature is the temperature, which is previously set by a user, of the toilet seat section, and the control section drives the heating element so as to increase the temperature of the toilet seat section higher than the second temperature at the time of user's seating on the toilet seat section.

11. The toilet seat device according to claim 1, wherein the toilet seat section is made of aluminum.

12. The toilet seat device according to claim 1, wherein the heating element is a lamp heater.

13. A toilet apparatus comprising:

a toilet bowl; and the toilet seat device according to claim 1.

* * * * *